US011511900B2

(12) United States Patent
Visoky et al.

(10) Patent No.: US 11,511,900 B2
(45) Date of Patent: Nov. 29, 2022

(54) ADJUSTABLE FRAME MOUNT FOR PROCESS UNIT

(71) Applicant: Osgood Industries, LLC, Oldsmar, FL (US)

(72) Inventors: Nick Visoky, Tampa, FL (US); Alan Snyder, New Port Richey, FL (US); Brandon Hallinan, Land O' Lakes, FL (US)

(73) Assignee: OSGOOD INDUSTRIES, LLC, Oldsmar, FL (US)

( * ) Notice: Subject to any disclaimer, the term of this patent is extended or adjusted under 35 U.S.C. 154(b) by 98 days.

(21) Appl. No.: 17/205,549

(22) Filed: Mar. 18, 2021

(65) Prior Publication Data

US 2022/0297867 A1 Sep. 22, 2022

(51) Int. Cl.

| | |
|---|---|
| ***B65B 59/04*** | (2006.01) |
| ***B65B 43/54*** | (2006.01) |
| ***B65B 7/28*** | (2006.01) |
| ***B65B 3/04*** | (2006.01) |

(52) U.S. Cl.

CPC ..... *B65B 59/04* (2013.01); *B65B 3/04* (2013.01); *B65B 7/28* (2013.01); *B65B 43/54* (2013.01)

(58) Field of Classification Search

CPC .. B65B 59/04; B65B 3/04; B65B 7/28; B65B 43/54

USPC ..... 53/201

See application file for complete search history.

(56) References Cited

U.S. PATENT DOCUMENTS

| | | | | |
|---|---|---|---|---|
| 1,878,983 | A * | 9/1932 | Harris | H02K 5/26 248/657 |
| 2,798,607 | A | 7/1957 | Hoffman | |
| 3,014,685 | A | 12/1961 | Jensen et al. | |
| 3,680,238 | A | 8/1972 | Arnold | |
| 3,910,917 | A | 10/1975 | Meyer | |
| 4,467,914 | A | 8/1984 | Trammel et al. | |
| 4,628,974 | A | 12/1986 | Meyer | |
| 4,694,635 | A * | 9/1987 | Marchetti | B65B 51/067 53/136.4 |

(Continued)

OTHER PUBLICATIONS

Office Action issued from the US Patent Office for U.S. Appl. No. 17/205,599 dated Feb. 7, 2022 (8 Pages).

*Primary Examiner* — Dariush Seif

(74) *Attorney, Agent, or Firm* — Michael Best & Friedrich LLP

(57) ABSTRACT

A modular processing machine comprising a module including a mounting plate, a rail extending a longitudinal axis, the rail being connected to the mounting plate, and a first longitudinal alignment plate fastened to the rail at a predetermined longitudinal distance from the mounting plate. The module further comprises a jack screw connected to the first longitudinal alignment plate. The module further comprises a process unit including a second longitudinal alignment plate connected to the jack screw and supported by the rail, the process unit being mounted to the second longitudinal alignment plate and being operable to perform a task associated with the module. The jack screw is operable to translate the process unit along the rail between a first longitudinal position relative to the first longitudinal alignment plate and a second longitudinal position displaced from the first longitudinal position.

20 Claims, 20 Drawing Sheets

(56) References Cited

U.S. PATENT DOCUMENTS 4,751,807 A * 6/1988 Couturier ..... B65B 63/04 53/429
4,856,263 A * 8/1989 Schneider ..... B65G 65/00 414/794.9
4,977,727 A * 12/1990 Milleson ..... B65B 35/36 53/247
5,188,479 A 2/1993 Nehls
5,255,490 A * 10/1993 Chiu ..... B29C 66/43121 53/368
5,553,843 A 9/1996 Schenk
5,598,784 A * 2/1997 Kubsik ..... B65G 21/06 104/111
5,628,163 A * 5/1997 Keopple ..... B65B 61/08 53/374.4
5,638,417 A * 6/1997 Boyer ..... B65B 37/04 377/6
5,661,954 A * 9/1997 Ivanov ..... B65B 35/26 53/118
6,081,981 A * 7/2000 Demarest ..... A61B 17/06004 29/430
6,293,408 B1 * 9/2001 Behnke ..... B07C 5/36 209/540
6,688,075 B2 * 2/2004 Cristina ..... B65B 59/003 53/50
6,705,461 B2 3/2004 Kuharevicz et al.
6,854,397 B2 2/2005 Terajima et al.
6,889,824 B2 5/2005 Leisner et al.
7,266,993 B2 9/2007 Strand et al.
7,328,544 B2 * 2/2008 Yokota ..... B65B 9/207 53/167
7,533,710 B2 * 5/2009 Michalski ..... B65C 9/42 156/DIG. 4
7,673,741 B2 3/2010 Nemedi
7,837,030 B2 11/2010 Daly et al.
8,360,225 B2 1/2013 Spangler et al.
8,910,917 B1 * 12/2014 Bees ..... F16M 7/00 248/676
8,925,718 B2 * 1/2015 Miles ..... B65G 21/06 198/860.1
9,290,328 B2 3/2016 Landolt
9,410,740 B2 8/2016 Yu et al.
9,476,244 B2 * 10/2016 Miller ..... E06B 3/4636
10,066,709 B2 * 9/2018 Greer ..... F16H 7/02
2005/0144908 A1 * 7/2005 Yang ..... B65B 7/2835 53/331.5
2005/0211534 A1 9/2005 Tefend
2008/0034710 A1 * 2/2008 Ehrmann ..... B65B 9/04 53/389.2
2009/0248190 A1 * 10/2009 Spangler ..... B23Q 37/005 198/860.2
2009/0260322 A1 * 10/2009 Fischer ..... B65B 41/16 53/167
2012/0118476 A1 * 5/2012 Weiler ..... B29C 66/43 228/103
2013/0220772 A1 * 8/2013 Vasse ..... B65G 47/841 198/431
2014/0157731 A1 * 6/2014 Perazzo ..... B65B 3/003 141/2
2016/0200469 A1 * 7/2016 Benedetti ..... B65B 43/345 53/381.1
2017/0225810 A1 * 8/2017 Cassoli ..... B65B 59/001
2018/0029736 A1 * 2/2018 Fioravanti ..... B65B 65/00
2018/0127133 A1 * 5/2018 Budde ..... H05B 6/103
2018/0146817 A1 * 5/2018 Piras ..... A47J 31/465
2018/0229873 A1 * 8/2018 Nakamoto ..... B65B 43/28
2019/0185188 A1 * 6/2019 Palumbo ..... B65B 61/02
2019/0308759 A1 * 10/2019 Jackson ..... B65B 29/00
2019/0351456 A1 * 11/2019 Palumbo ..... B65B 59/003
2019/0352109 A1 * 11/2019 Morino ..... B65B 5/045
2019/0375530 A1 * 12/2019 Mora Flores ..... B65B 43/32
2020/0113786 A1 * 4/2020 Gamberini ..... B65B 1/38
2021/0114757 A1 * 4/2021 Buhrer ..... B65B 61/186
2021/0130024 A1 * 5/2021 Liu ..... B65B 51/067

* cited by examiner

ADJUSTABLE FRAME MOUNT FOR PROCESS UNIT

FIELD OF THE DISCLOSURE

The present disclosure relates to an adjustable frame mount for a process unit, and more particularly to structures for obtaining alignment between a process unit and a modular machine frame.

BACKGROUND OF THE INVENTION

Cup filling and sealing apparatuses are used to fill and contain comestibles in liquid or semi-liquid form within a cup. Various steps of packaging a comestible within a cup are performed in series. Such steps may include filling, sealing, and capping the cup. Some existing cup filling and sealing apparatuses include a conveyor for passing cups between modules of the cup filling and sealing apparatus. Machines for completing each of the steps can be mounted on a frame. However, as the conveyor passes the cup between each machine, it is important to locate each machine at a desired position.

SUMMARY OF THE INVENTION

The present invention provides, in one aspect, a modular processing machine including a plurality of process units for completing a series of sequential tasks on a work piece conveyed through the modular processing machine. The modular processing machine comprises a module including a mounting plate, a rail extending a longitudinal axis, the rail being connected to the mounting plate, and a first longitudinal alignment plate fastened to the rail at a predetermined longitudinal distance from the mounting plate. The modular processing machine further comprises a jack screw connected to the first longitudinal alignment plate. The modular processing machine further comprises a process unit including a second longitudinal alignment plate connected to the jack screw and supported by the rail, the process unit being mounted to the second longitudinal alignment plate and being operable to perform a task associated with the module. The jack screw is operable to translate the process unit along the rail between a first longitudinal position relative to the first longitudinal alignment plate and a second longitudinal position displaced from the first longitudinal position.

The present invention provides, in another aspect, a modular processing machine including a plurality of process units for completing a series of sequential tasks on a workpiece conveyed through the modular processing machine. The modular processing machine comprises a first module including a first rail extending along a longitudinal axis, the first rail having a first axial end, and a first longitudinal alignment plate fastened to the first rail at a predetermined longitudinal distance from the first axial end. The modular processing machine further comprises a jack screw connected to the first longitudinal alignment plate. The modular processing machine further comprises a first processing unit mounted within the first module on the first rail, the first process unit being operable to perform a first task associated with the first module, the first process unit including a second longitudinal alignment plate connected to the jack screw and supported by the first rail. The modular processing machine further comprises a second module including a second rail extending coaxially with the longitudinal axis, the second rail having a second axial end connected to the first axial end. The second module further comprises a second process unit operable to perform a second task associated with the second module, the second process unit being mounted within the second module on the second rail. The jack screw is operable to shift the second longitudinal alignment plate relative to the first longitudinal alignment plate in a longitudinal direction between a first longitudinal position relative to the first axial end and a second longitudinal position displaced from the first longitudinal position.

The present invention provides, in another aspect, a modular processing machine including a plurality of process units for completing a series of sequential tasks on a work piece conveyed through the modular processing machine. The modular processing machine comprises a module including a mounting plate and a rail extending along a longitudinal axis, the rail being connected to the mounting plate. The modular processing machine further comprises a first longitudinal alignment plate fastened to the rail at a predetermined longitudinal distance from the mounting plate and a jack screw connected to the first longitudinal alignment plate. The modular processing machine further comprises a process unit including a second longitudinal alignment plate connected to the jack screw and supported by the rail, the process unit being mounted to the second longitudinal alignment plate and being operable to perform a task associated with the module. The jack screw is operable to translate the process unit along the rail between a first longitudinal position relative to the first longitudinal alignment plate and a second longitudinal position displaced from the first longitudinal position.

The present invention provides, in another independent aspect, a modular processing machine including a plurality of process units for completing a series of sequential tasks on a workpiece conveyed through the modular processing machine. The modular processing machine comprises a first module including a first rail extending along a longitudinal axis, the first rail having a first axial end. The first module further includes a first longitudinal alignment plate fastened to the first rail at a predetermined longitudinal distance from the first axial end and a jack screw connected to the first longitudinal alignment plate. The first module further includes a first process unit mounted within the first module on the first rail, the first process unit being operable to perform a first task associated with the first module, the first process unit including a second longitudinal alignment plate connected to the jack screw and supported by the first rail. The modular processing machine further comprises a second module including a second rail extending coaxially with the longitudinal axis, the second rail having a second axial end connected to the first axial end, and a second process unit operable to perform a second task associated with the second module, the second process unit mounted within the second module on the second rail. The jack screw is operable to shift the second longitudinal alignment plate relative to the first longitudinal alignment plate in a longitudinal direction between a first longitudinal position relative to the first axial end and a second longitudinal position displaced from the first longitudinal position.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
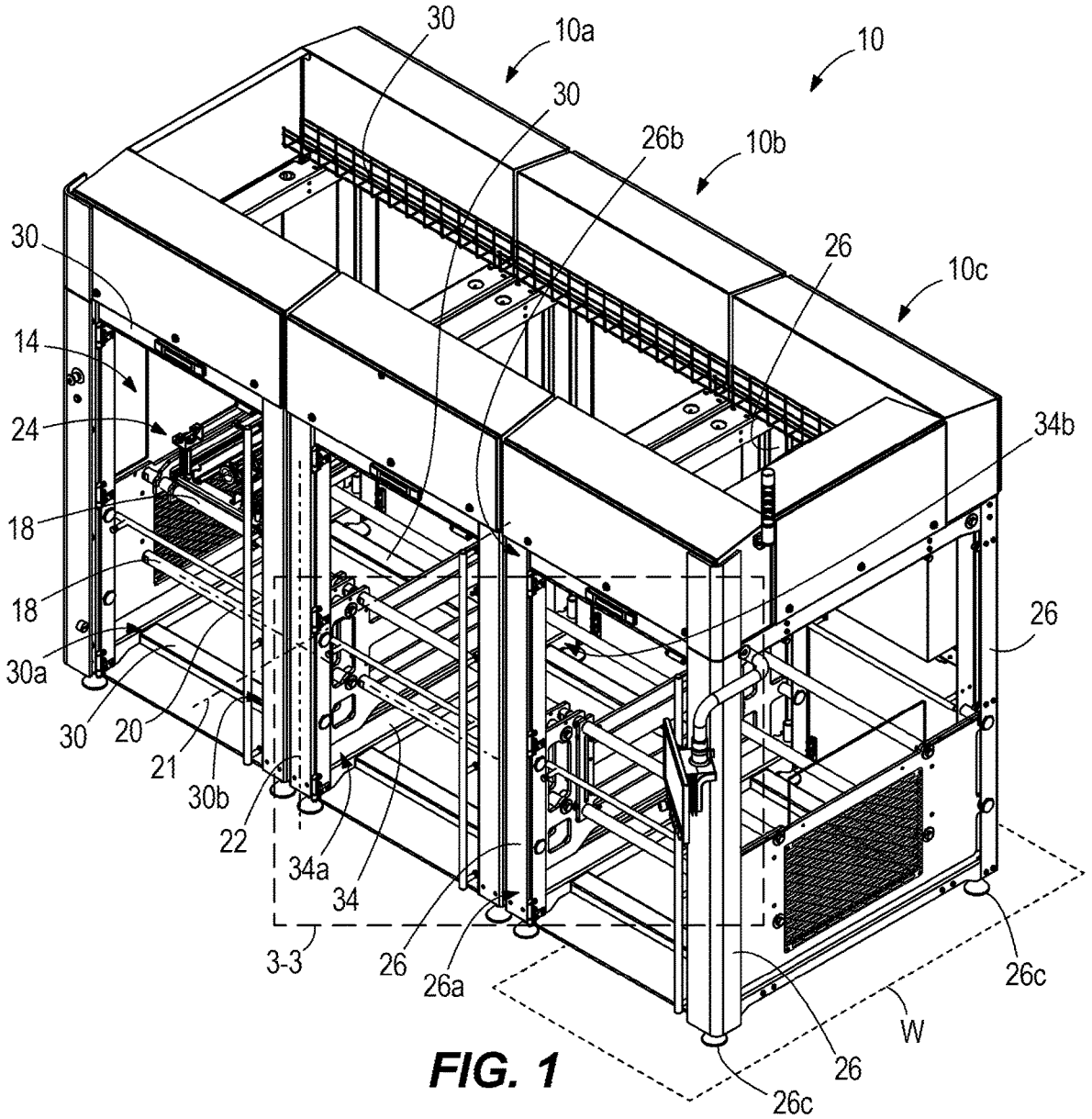
FIG. 1 is a perspective view of a modular machine system.

FIG. 1 illustrates a cup filling and sealing apparatus 10 which is subdivided into three modules 10*a*, 10*b*, and 10*c* and supported by a work surface W. Each module 10*a*-10*c* includes a frame 14. Each frame 14 further comprises rails 18 which operatively align the three modules 10*a*-10*c*. The rails 18 support at least one functional process unit 24. Each rail 18 extends parallel to a longitudinal axis 20 defined by the center of one of the rails 18 such that the rails 18 of each of the three modules 10*a*-10*c* are aligned axially along the longitudinal axis 20. As will be discussed below, the interconnection of the modules 10*a*-10*c* through the rails 18 retains the alignment of each module 10*a*-10*c* such that the process units 24 mounted on the rails 18 are mounted in an aligned and predetermined location and orientation on the rails 18.

The functional process units 24 of the illustrated apparatus 10 relate to operations for a cup filling and sealing process for filling and sealing comestibles within a cup (not shown). However, the modules 10*a*-10*c*, frames 14, and rails 18 may be used in other contexts.

As markets change and user needs adapt, functions may need to be added or removed from the apparatus 10. For example, the apparatus 10 may be expanded to include an additional module 10*d* having a process unit 24 capable of disinfecting the cup. In some situations, it is important that the apparatus 10 has each functional process unit 24 installed adjacent an existing functional process unit 24. For example, an exemplary process unit 24 operable to apply comestibles to the cup may need to be located adjacent another exemplary process unit 24 operable to apply a cap to the cup to protect the comestibles from the environment. In some constructions, the apparatus 10 is self-contained in a relatively small package which can be readily transported to and positioned adjacent any one of several sources of comestibles being packaged.

The apparatus 10 allows for fully customizable layout of the module 10*a*-10*c* and permits various different functional process units 24 to be mounted within each module 10*a*-10*c* for completing various tasks related to cup filling and sealing. As a result, the number of repeated parts in the apparatus 10 is increased, and the number of unique parts is decreased. Individual modules 10*a*-10*c* can be assembled, tested, and shipped to the end user quickly and economically. The modules 10*a*-10*c* can be connected at a manufacturing site and shipped to the end user. Similarly, individual functional process units 24 can be assembled, tested, and shipped to the user quickly and economically for connection to a module 10*a*-10*c* at the site of the apparatus 10. Further, the end user is able to disassemble parts of the apparatus 10 and rebuild it in a different configuration, i.e., with a different particular arrangement of the modules 10*a*-10*c* (or additional modules not shown herein).

In the illustrated embodiment of FIG. 1, each frame 14 is generally in the form of a rectangular prism. The frame 14 has a length along the longitudinal axis 20, a width along a lateral axis 21 perpendicular to the longitudinal axis 20, and a height along a vertical axis 22 perpendicular to both the longitudinal axis 20 and the lateral axis 21. Each frame 14 includes a plurality of columns 26 (e.g., four columns) extending parallel to the vertical axis 22 from a lower end 26*a* to an upper end 26*b*, longitudinal members 30 extending parallel to the longitudinal axis 20 and connecting adjacent columns 26 along the longitudinal axis 20 from an upstream end 30*a* to a downstream end 30*b*, and lateral members 34 extending between adjacent columns 26 parallel to the lateral axis 21 from a first lateral end 34*a* to a second lateral end 34*b*. The upstream end 30*a* and the downstream end 30*b* also generally define an upstream end 30*a* and downstream end 30*b* of the module 10*a*. The illustrated embodiment includes two longitudinal members 30 and two lateral members 34 located adjacent the lower end 26*a* and the upper end 26*b* to interconnect each of the columns 26. In the illustrated embodiment, the lower ends 26*a* of the respective columns are supported on the work surface W by respective feet 26*c*. In other constructions, the frames 14 or portions thereof are modified to take other forms so as to change the various dimensional aspect ratios, the number or shape of frame members, and/or the placement thereof.

Figure 5:
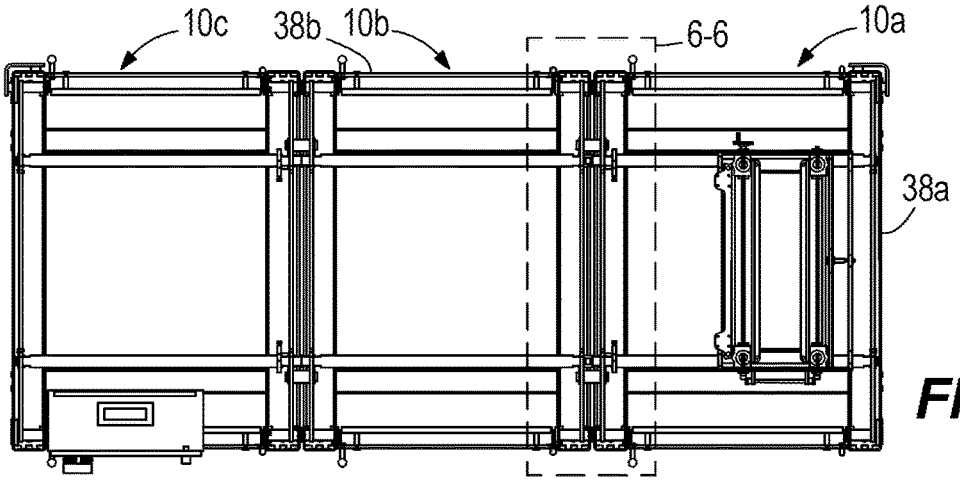
FIG. 5 is a cross-sectional view of the modular machine system of FIG. 1 taken along section line 5-5 in FIG. 4.
Figure 6:
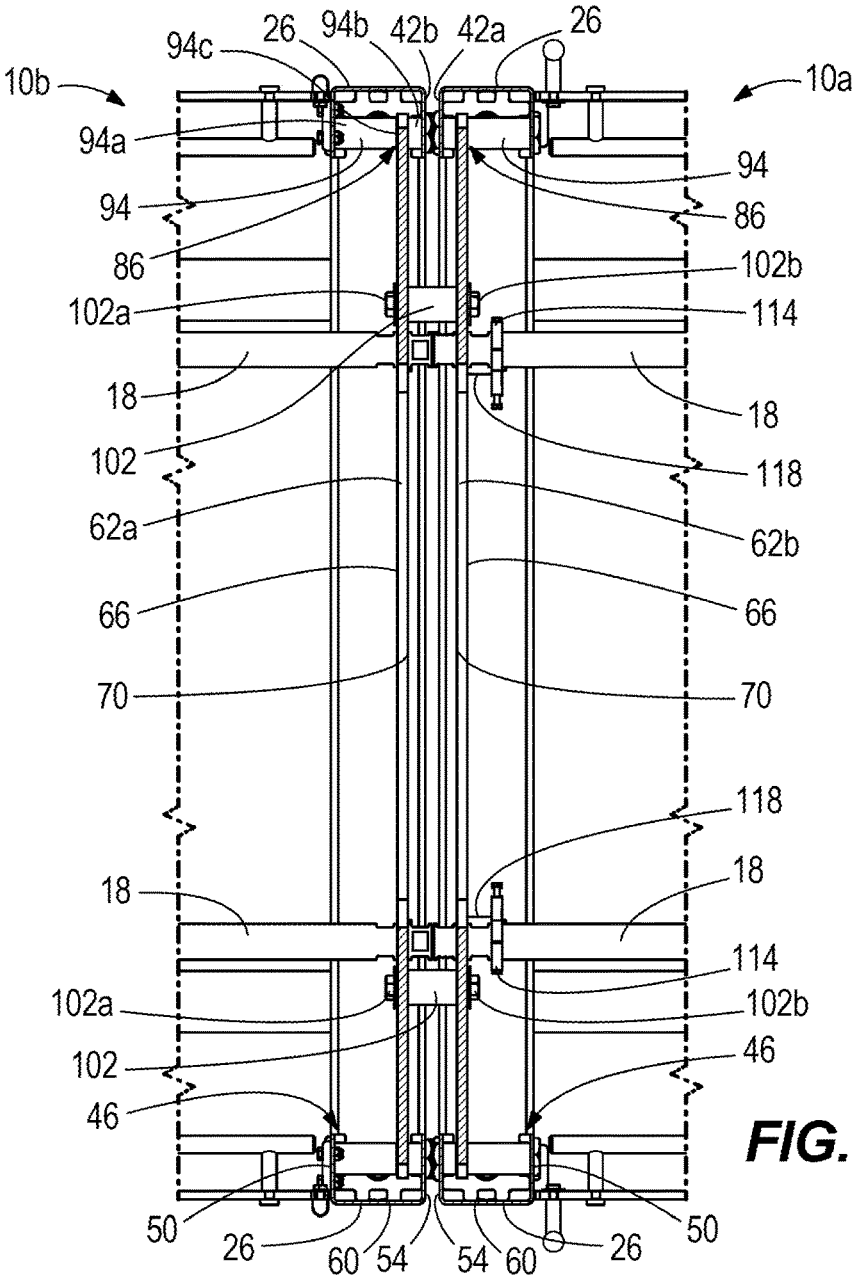
FIG. 6 is an enlarged cross-sectional view of the modular machine system of FIG. 1 taken along section line 6-6 in FIG. 5.

As shown in FIG. 5, the columns 26 of the first module define a periphery 38*a* of the rectangular prism-shaped frame 14 of the first module 10*a*. The periphery 38*a* of the frame 14 of the first module 10*a* does not interfere with a periphery 38B of the frame 14 of the second module 10*b*. In fact, the periphery 38*a* of the first module 10*a* is spaced from the periphery 38B of the second module 10*b*. As illustrated in FIG. 6, the columns 26 of the first module 10*a* have an outer surface 42*a* that is axially located at a position along the longitudinal axis 20 spaced from the columns 26 of the second module 10*b*. Similarly, the columns 26 of the second module 10*b* have an outer surface 42*b* that is axially located at a position along the longitudinal axis 20 spaced from the columns 26 of the first module 10*a*.

With reference to FIGS. 5 and 6, each column 26 has a cross sectional profile 46 taken perpendicular to the vertical axis 22 that is a C-channel. Each column 26 has an inwardly facing channel arm 50, an outwardly facing channel arm 54, and a channel body 60 spanning the channel arms 50, 54. In the frame 14, the inwardly facing channel arm 50 faces the longitudinal center of the frame 14. In the frame 14, the outwardly facing channel arm 54 faces away from the longitudinal center of the frame 14. In the frame 14, adjacent columns 26 in the lateral direction (i.e., columns aligned along a common lateral axis 21) have channel bodies 60 which face each other. In the frame 14, adjacent columns 26 in the longitudinal direction (i.e., columns aligned parallel with respect to each other along the longitudinal axis 20) have respective channel arms 50, 54 which face each other. The channel body 60 is in a plane defined by the longitudinal axis 20 and the vertical axis 22. The channel arms 50, 54 are in separate planes defined by the lateral axis 21 and the vertical axis 22. As such, the channel arms 50, 54 extend laterally (i.e., perpendicularly from the longitudinal axis 20).

Figure 3:
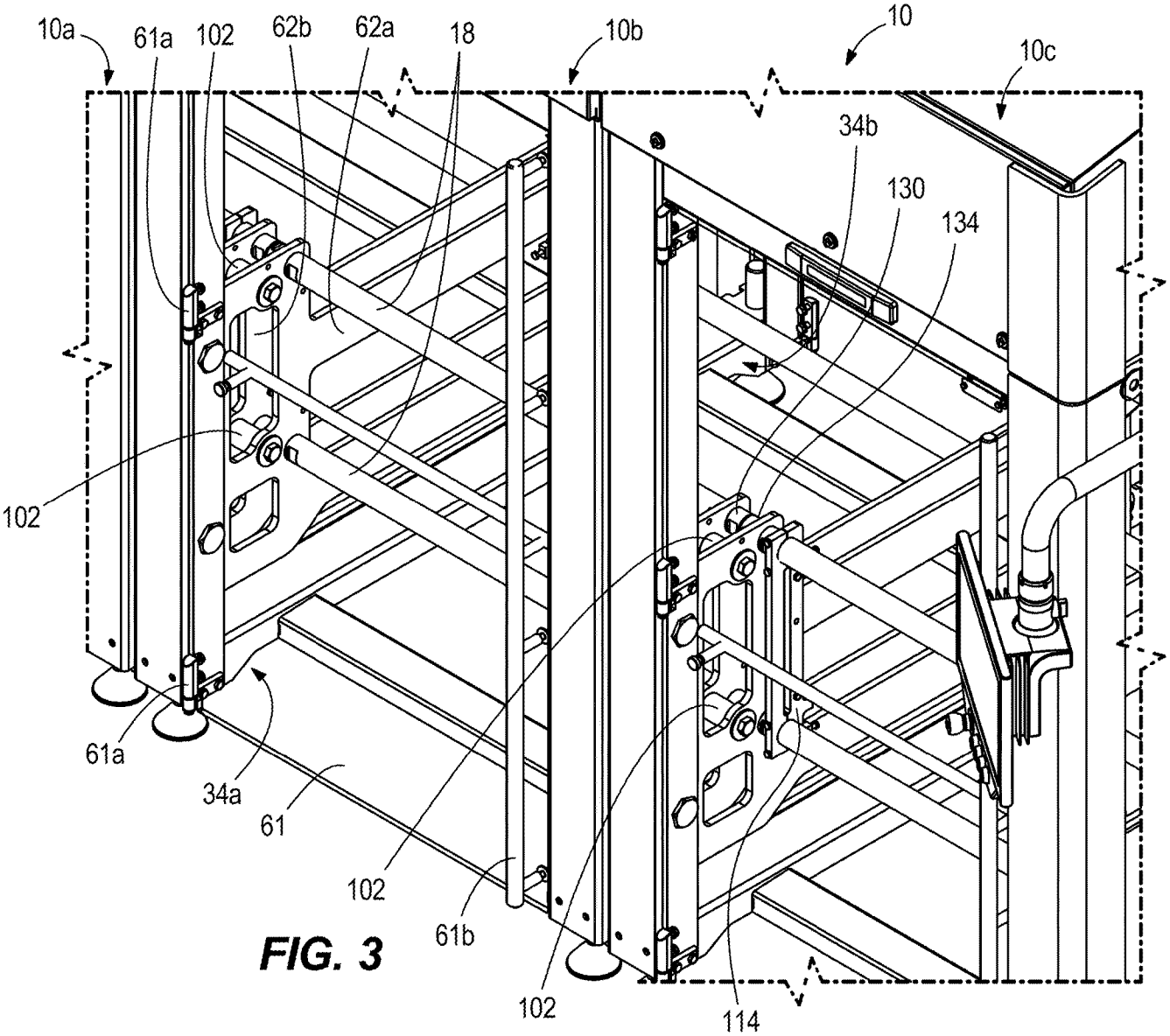
FIG. 3 is an enlarged perspective view of the modular machine system of FIG. 1 taken along section line 3-3 in FIG. 1.
Figure 3A:
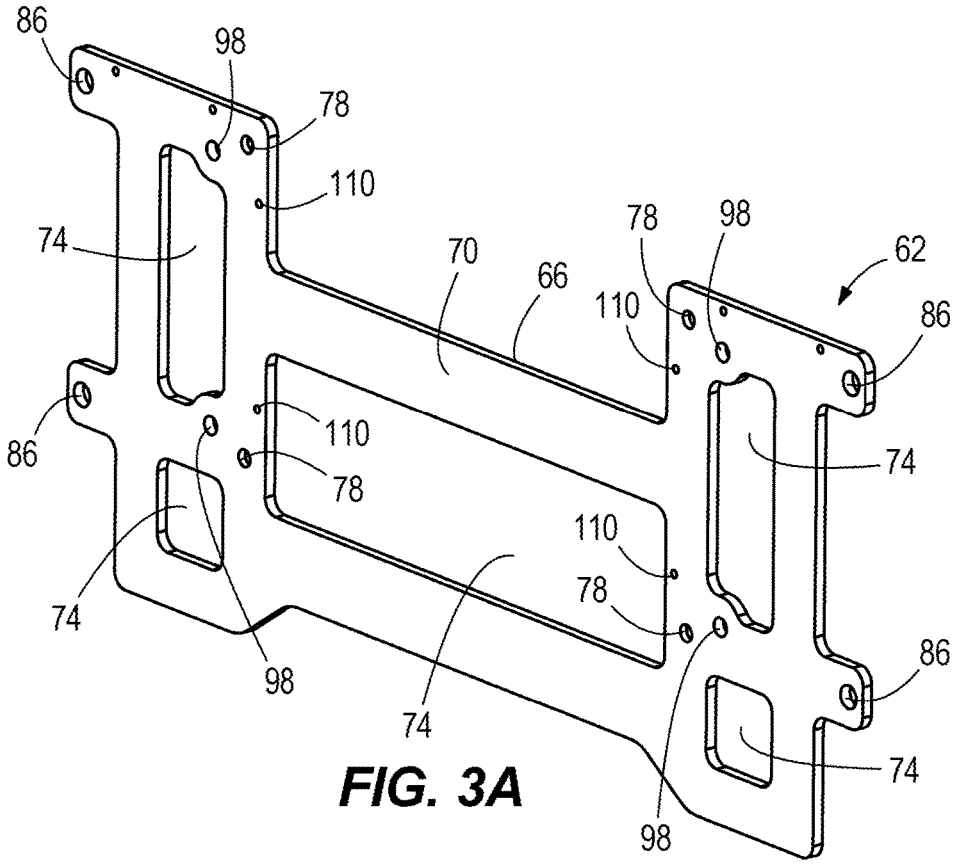
FIG. 3A is a perspective view of a mounting plate of the modular machine system of FIG. 1 showing the outwardly facing side of the mounting plate.
Figure 3B:
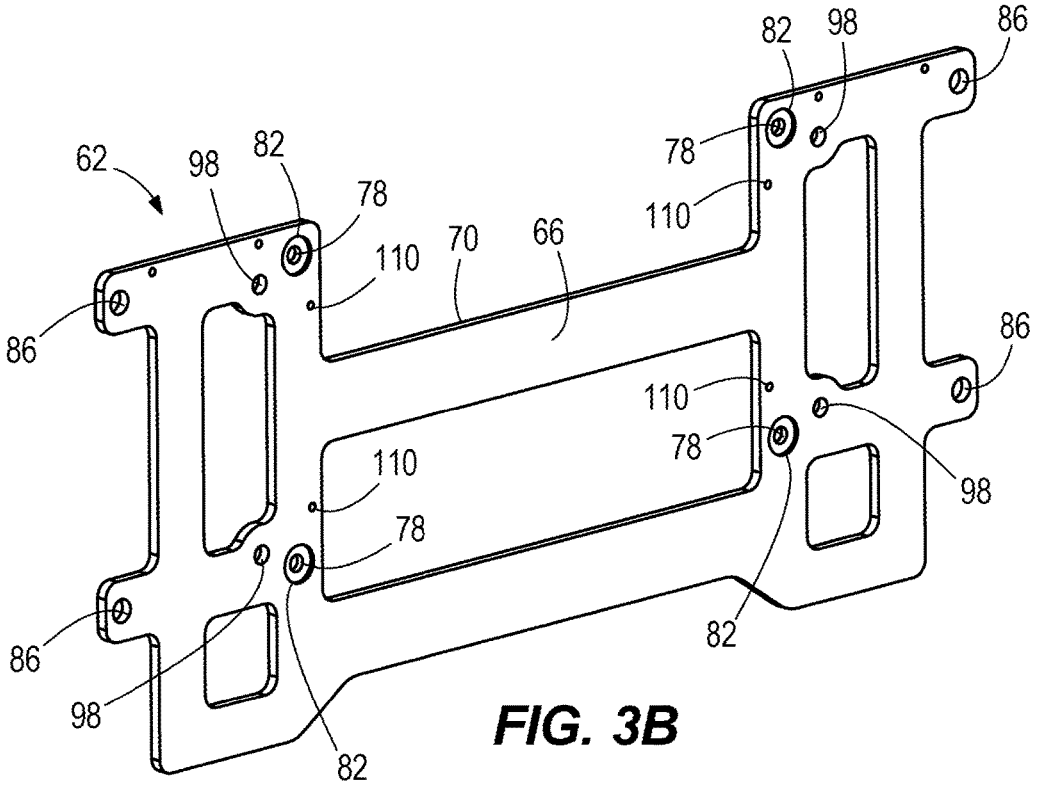
FIG. 3B is a perspective view of the mounting plate of the modular machine system of FIG. 1 showing the inwardly facing side of the mounting plate.
Figure 3C:
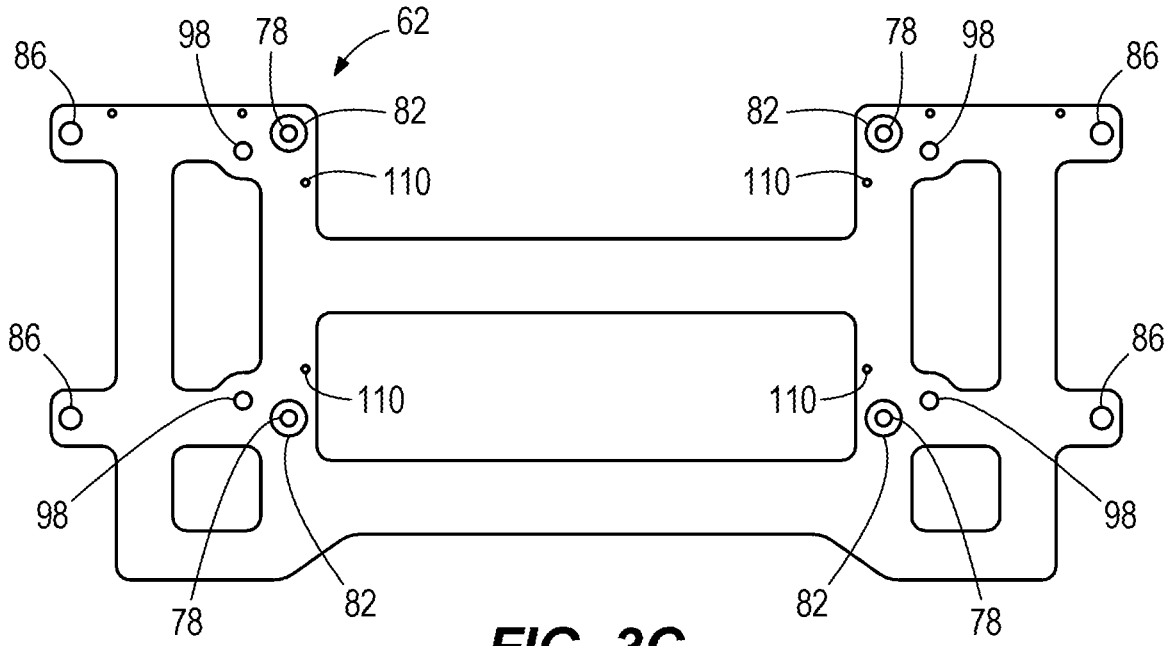
FIG. 3C is an end view of the mounting plate of the modular machine system of FIG. 1 showing the inwardly facing side of the mounting plate.
Figure 3D:
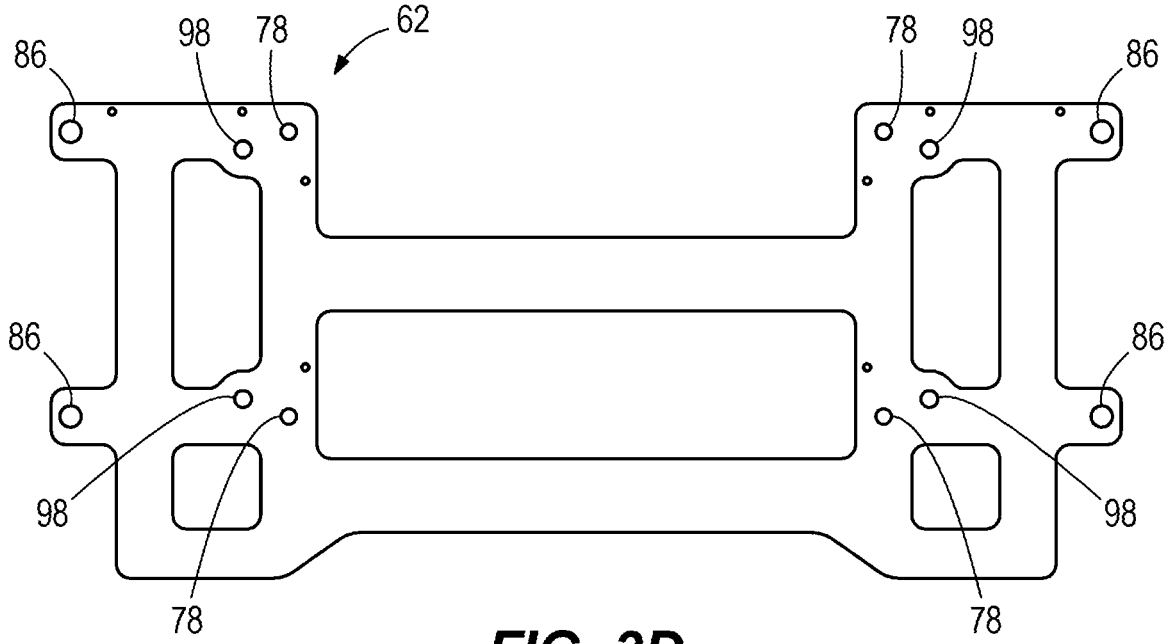
FIG. 3D is an end view of the mounting plate of the modular machine system of FIG. 1 showing the outwardly facing side of the mounting plate.

As illustrated in FIG. 3, the frame 14 further comprises a guard door 61 located on a lateral side of the frame 14 corresponding with the first lateral end 34*a*. The guard door 61 is connected to the frame 14 by a hinge 61*a*. As such, the guard door 61 is pivotable relative to the frame 14 to permit or restrict access to the interior of the frame 14. As user may pivot the guard door 61 by a handle 61*b* located on an opposite side of the guard door 61 as the hinge 61*a*.

With continued reference to FIG. 3, the frame 14 of the module 10*a* further comprises mounting plates 62 connected to adjacent columns 26 in the lateral direction (i.e., columns aligned by a common lateral axis 21). Each frame 14 includes an upstream mounting plate 62*a* and a downstream mounting plate 62*b*. The upstream mounting plate 62*a* is located adjacent the upstream end 30*a* of the longitudinal members 30, and the downstream mounting plate 62*b* is located adjacent the downstream end 30*b* of the longitudinal members 30.

FIGS. 3A-3D illustrate one of the mounting plates 62 in detail. The mounting plate 62 includes an inwardly facing side 66 which faces the center of the frame 14 (i.e., towards the center of the frame 14 in the longitudinal direction along the longitudinal axis 20) and an outwardly facing side 70 which faces away from the center of the frame 14 (i.e., away from the center of the frame 14 in the longitudinal direction along the longitudinal axis 20). The mounting plate 62 includes a number of voids or cutouts 74 configured to reduce the weight of the mounting plate 62 and permit passage of objects through the cutouts 74.

With continued reference to FIGS. 3A-3D, the mounting plate 62 includes four rail holes 78 in the form of through holes passing through the inwardly facing side 66 to the outwardly facing side 70. In the illustrated embodiment, the rail holes 78 are counterbored rail holes 78 with counterbore surfaces 82 on the inwardly facing side 66. In the illustrated embodiment, the rail holes 78 are parallel to the longitudinal axis 20. The counterbore surfaces 82 are perpendicular to the longitudinal axis 20. In the illustrated embodiment, the rail holes 78 are positioned in a rectangular array along a plane that extends parallel to the vertical axis 22 and the lateral axis 21. The rail holes 78 may be otherwise located in the mounting plate 62 so long as they are parallel to the longitudinal axis 20.

With continued reference to FIGS. 3A-3D, the mounting plate 62 includes four column holes 86 configured for attaching the mounting plate 62 to two adjacent columns 26 in the lateral direction (i.e., columns at a common longitudinal position and spaced apart parallel to the lateral axis 21). In the illustrated embodiment, the column holes 86 are also positioned in a rectangular array. In the illustrated embodiment, the column holes 86 are located more laterally spread apart than the rail holes 78, but otherwise at a same common height relative to the work surface W.

As illustrated in FIG. 6, fasteners 94 extend through the column holes 86 to connect the mounting plate 62 to the channel arms 50, 54 of the each of the two adjacent columns 26 in the lateral direction (i.e., columns at a common longitudinal position and spaced apart parallel to the lateral axis 21). In the illustrated embodiment, the fasteners 94 extend through both of the channel arms 50, 54 along the longitudinal direction. As such, the mounting plate 62 is secured to the frame 14 within the periphery 38*a* of the frame 14 of the first module 10*a*. Additionally, when mounted to the frame 14, the mounting plate 62 is generally planar with a plane defined by the vertical axis 22 and the lateral axis 21.

With continued reference to FIG. 6, each of the fasteners 94 include a first bolt 94*a* and a second bolt 94*b* on either longitudinal side of the mounting plate 62. Each fastener 94 may include an isolator 94*c* positioned longitudinally between the first bolt 94*a* and the mounting plate 62. The fastener 94 may further include another isolator 94*c* positioned longitudinally between the second bolt 94*b* and the mounting plate 62. The isolator 94*c* may permit the mounting plate 62 to deflect axially along the longitudinal axis 20 as required to retain axial alignment of the rails 18 of adjacent modules 10*a*, 10*b*. The isolators 94*c* are elastomeric or otherwise deflectable to permit axial deflection of the mounting plate 62. In the illustrated embodiment, fasters 94 include isolators 94*c* on one lateral side of the apparatus 10. In other words, the isolators 94*c* are applied only to the fasteners 94 which connect mounting plate 62 to two adjacent columns 26 in the longitudinal direction (i.e., columns at a common lateral position spaced apart parallel to the longitudinal axis 20).

With continued reference to FIGS. 3A-3D, the mounting plate 62 includes four spacer holes 98 configured for attaching the downstream mounting plate 62*b* of the first module 10*a* to the upstream mounting plate 62*a* of the second module 10*b*. In the illustrated embodiment, the spacer holes 98 are also positioned in a rectangular array. In the illustrated embodiment, each of the spacer holes 98 are located at a lateral position between the rail holes 78 and the column holes 86 and at a vertical position between the common height of the rail holes 78 and the column holes 86.

As illustrated in FIG. 6, spacers 102 are configured to space the downstream mounting plate 62*b* of the first module 10*a* from the upstream mounting plate 62*a* of the second module 10*b*. In the illustrated embodiment, the spacers 102 are located between, e.g., directly between, the downstream mounting plate 62*b* of the first module 10*a* and the upstream mounting plate 62*a* of the second module 10*b*. The spacers 102 are fastened to the downstream mounting plate 62*b* of the first module 10*a* and the upstream mounting plate 62*a* of the second module 10*b* to set an axial position (or in other words, inhibit axial deflection) of the first module 10*a* relative to the second module 10*b* parallel to the longitudinal axis 20. In the illustrated embodiment, the spacers 102 define a mechanically bolted interface between the downstream mounting plate 62*b* of the first module 10*a* and the upstream mounting plate 62*a* of the second module 10*b*. In the illustrated embodiment, the spacers 102 have axial ends which are engaged by bolts 102*a*, 102*b* such that the spacers 102 act as two-sided nuts connecting the bolts 102*a*, 102*b* to form an attachment between the first module 10*a* and the second module 10*b* independent of the rails 18. The bolts 102*a*, 102*b* rest upon the inwardly facing surface 66 of the respective mounting plates 62 of the first and second modules 10*a*, 10*b*.

Figure 2:
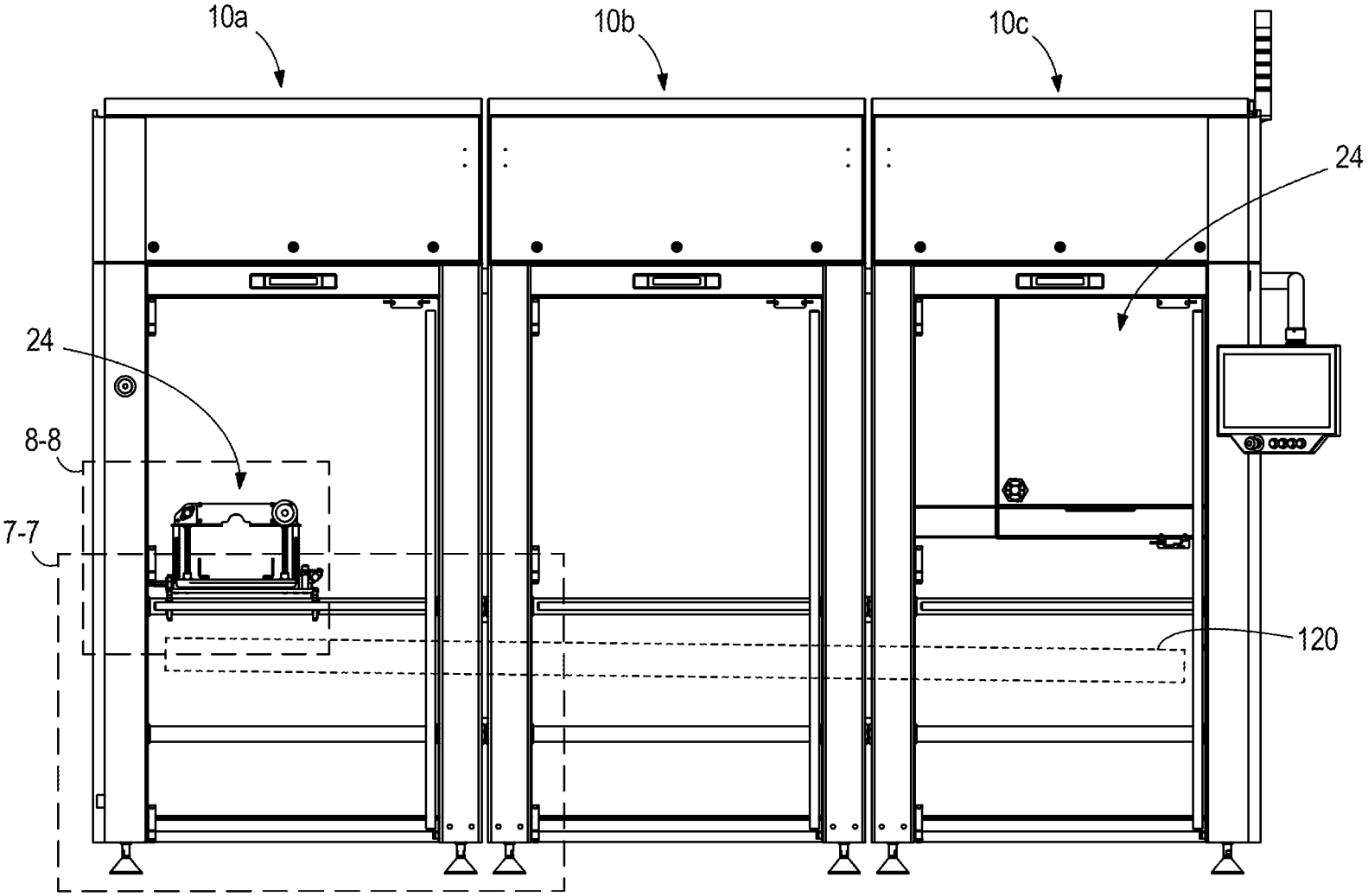
FIG. 2 is a front view of the modular machine system of FIG. 1.
Figure 7:
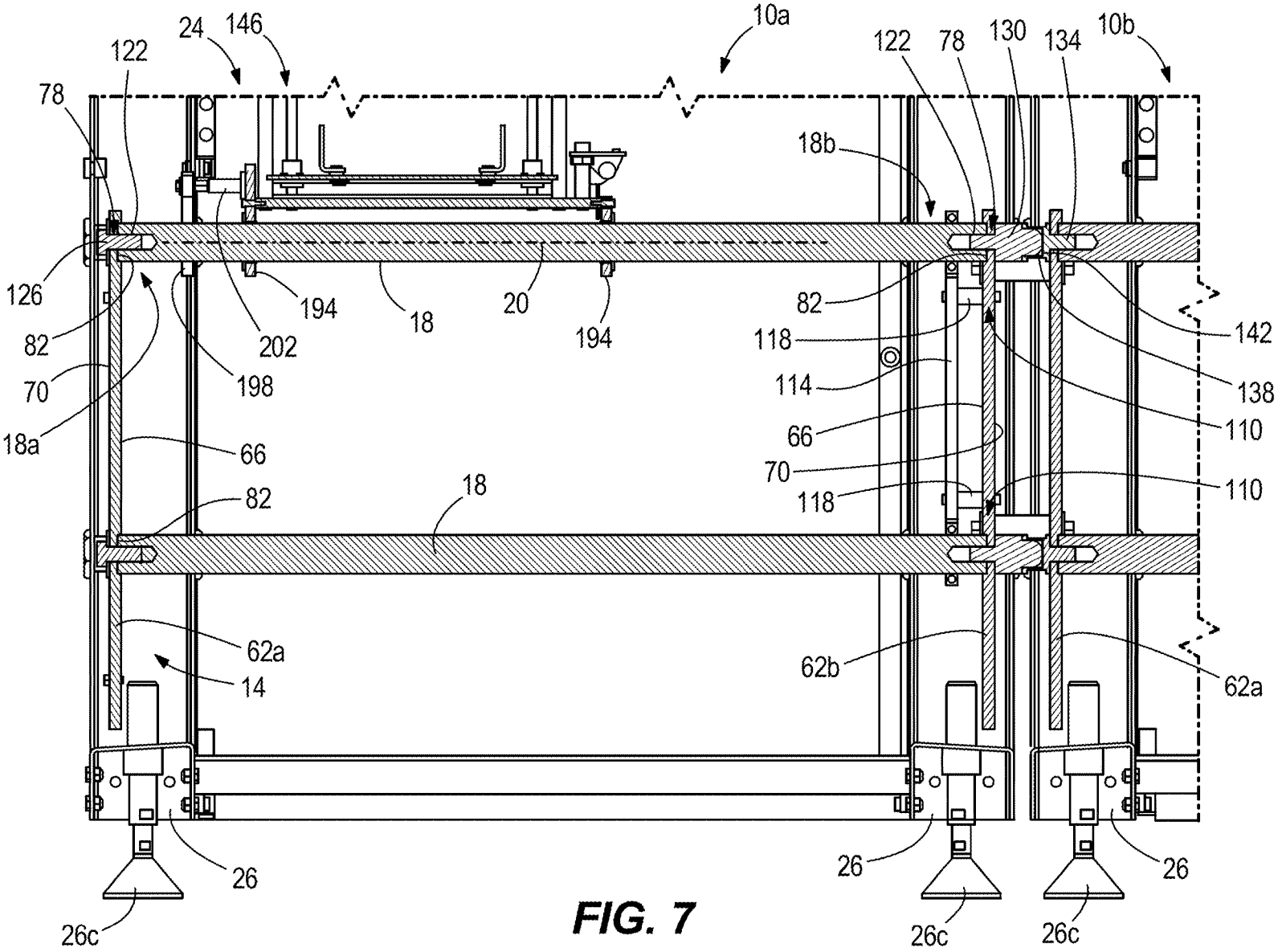
FIG. 7 is an enlarged cross-sectional view of the modular machine system of FIG. 1 taken along section line 7-7 in FIG. 4

Finally, with reference to FIGS. 3A-3D and reference to FIG. 3, the mounting plate 62 includes four conveyor mount holes 110 configured for attaching a conveyor mount 114 to both the mounting plate 62 and the rails 18. The conveyor mount 114 is best illustrated in FIGS. 3 and 7. The conveyor mount 114 circumscribes the rails 18 (FIG. 3), and is further attached to the frame 14 through fasteners 118 which secure the conveyor mount 114 to the conveyor mount holes 110 of the mounting plate 62 (FIG. 7). The conveyor mount 114 is configured to support a conveyor 120 (FIG. 2) on the apparatus 10.

The conveyor 120 (FIG. 2) is configured to pass the cup between successive modules 10*a*-10*c* of the apparatus 10 such that the process unit 24 within each successive module 10*a*-10*c* completes a successive task on the cup. The cup may be substituted for another work piece in realms outside of cup filling and sealing. The conveyor 120 may be an intermittent conveyor capable of conveying and stopping at a process unit 24 for the process unit 24 to complete the task on the cup. The intermittent conveyor 120 may convey an index length along the longitudinal axis 20 before stopping at a process unit 24.

As best illustrated in FIG. 7, the rails 18 each have an upstream end 18*a* and a downstream end 18*b*. The upstream end 18*a* and the downstream end 18*b* each have a receiver 122 at an axial end thereof. The receiver 122 extends parallel to the longitudinal axis 20 towards the center of the rail 18 from the respective end 18*a*, 18*b*. The receivers 122 can be blind threaded holes in some constructions, as illustrated. The outboard alignment feature 126 and the inboard alignment features 130, 134 include shafts which are configured to engage the receiver 122 to secure the outboard alignment feature 126 and the inboard alignment features 130, 134 to the rails 18. The outboard alignment feature 126 and the inboard alignment features 130, 134 can be threaded shafts which engage the blind threaded holes of the receivers 122, as illustrated.

In the case of the modules 10*a*, 10*b* illustrated in FIG. 7, the upstream end 18*a* is received axially by the counterbored surfaces 82 of the holes 78 with the upstream end 18*a* abutting the counterbored surface 82 recessed from the inwardly facing surface 66 of the upstream mounting plate 62*a*. An outboard alignment feature 126 engages the receiver 122 of the upstream end 18*a* and the upstream mounting plate 62*a* to connect the rail 18 to the upstream mounting plate 62*a*, and thus, the frame 14. Similarly, the downstream end 18*b* is received axially by the counterbored surfaces 82 of the holes 78 with the downstream end 18*b* abutting the counterbored surface 82 recessed from the inwardly facing surface 66 of the downstream mounting plate 62*b*.

With continued reference to FIG. 7, a first inboard alignment feature 130 (i.e., a first alignment feature) is connected to the downstream end 18*b* of the first module 10*a*. The first inboard alignment feature 130 secures the downstream end 18*b* of the rail 18 of the first module 10*a* to the downstream mounting plate 62*b* of the first module 10*a*. The first inboard alignment feature 130 protrudes axially from the outwardly facing side 70 of the downstream mounting plate 62*b* of the first module 10*a*. A second inboard alignment feature 134 (i.e., a second alignment feature) is connected to the upstream end 18*a* of the second module 10*b*. The second inboard alignment feature 134 secures the upstream end 18*a* of the rail 18 of the second module 10*b* to the upstream mounting plate 62*a* of the second module 10*b*. The second inboard alignment feature 134 protrudes axially from the outwardly facing side 70 of the upstream mounting plate 62*a* of the first module 10*a*.

With reference to FIG. 7, in the assembly of the modules 10*a*, 10*b*, the rails 18 of the first module 10*a* and the second module 10*b* are aligned in coaxial pairs (e.g., four pairs), and all the rails 18 are parallel with the longitudinal axis 20—or in other words, define four parallel longitudinal axes. Axial clearance between the modules 10*a*, 10*b* is taken up until the inboard alignment features 130, 134 engage each other. Any remaining slack is taken up between the first module 10*a* and the second module 10*b* as the spacers 102 are tightened. This process is repeated for each aligned set of rails 18 between the two modules 10*a*, 10*b*. As such, the rail 18 of the first module 10*a* is coaxially and longitudinally secured to the rail 18 of the second module 10*b* with all of the rails 18 of both the first module 10*a* and the second module 10*b* being parallel to the longitudinal axis 20.

In the illustrated embodiment of FIG. 7, the first and second inboard alignment features 130, 134, are, respectively, male and female connectors. In the assembly of the apparatus 10, the first and second inboard alignment features 130, 134, as well as the outboard alignment feature 126, are coaxial (i.e., positioned along) with the longitudinal axis 20. The spacers 102 are removable from the mounting plates 62 of the first module 10*a* and the second module 10*b* such that the second module 10*b* is separable from the first module 10*a*. The first and second inboard alignment features 130, 134 extend through the rail holes 78 of the downstream mounting plate 62*b* of the first module 10*a* and of the upstream mounting plate 62*a* of the second module 10*b*, respectively.

With continued reference of FIG. 7, the male first inboard alignment feature 130 includes an outwardly projecting surface 138. As typical with female connectors, the female second inboard alignment feature 134 defines a void 142 operable to receive the outwardly projecting surface 138 of the first inboard alignment feature 130. In the illustrated embodiment, the outwardly projecting surface 138 is received within the void 142 to align the rail 18 of the second module 10*b* with the rail 18 of the first module 10*a*. When the outwardly projecting surface 138 is received within the void 142, it is said that the outwardly projecting surface 138 is secured with the void 142. Optionally, the outwardly projecting surface 138 is rounded or conical such that when the outwardly projecting surface 138 and the void 142 contact each other, the rounded or conical outwardly projecting surface 138 forces alignment of the rail 18 of the first module 10*a* with the rail 18 of the second module 10*b*. In the apparatus 10, the entirety of both outwardly projecting surface 138 and the void 142 are positioned between the downstream mounting plate 62*b* of the first module 10*a* and the upstream mounting plate 62*a* of the second module 10*b*.

With continued reference of FIG. 7, the outboard alignment feature 126, the male first inboard alignment feature 130, and the female second inboard alignment feature 134 are each made from 303 stainless steel. In other embodiments, the outboard and inboard alignment features 126, 130, 134 may be made from 304 or 316 stainless steel. In the illustrated embodiment, the male first inboard alignment feature 130 has an outer diameter of 35 mm+0/−0.1 mm. In the illustrated embodiment, the female first inboard alignment feature has an inner diameter of 35.1 mm+0.1/−0 mm. This permits the first inboard alignment feature 130 to nest within the second inboard alignment feature 134. In other embodiments, the materials, diameters, and tolerances of the first and second inboard alignment features 130, 134 may differ based on other design parameters of the apparatus 10.

As illustrated in FIG. 3, the connection between the rails 18 of second module 10*b* and the rails 18 of the third module 10*c* follows the same format as described with respect to the connection between the rails 18 of the first module 10*a* and the second module 10*b*. Both connections utilize the first and second inboard alignment features 130, 134. Successive modules 10*d* attached to the third module 10*c* also follow the same format as described with respect to the first module 10*a* and the second module 10*b*.

The apparatus 10 includes the conveyor mounted on the conveyor mount 114 and functioning in conjunction with the rails 18 to pass the cup between the process units 24 mounted within each module 10*a*-10*c* for each module to successively complete a task associated with filling the cup with a comestible and sealing the comestibles within the cup from the environment. The conveyor 120 is configured to hold, carry, and discharge various sized cups so to pass the cup between each of the process units 24 mounted within each of the modules 10*a*-10*c*. Other process units not related to cup filling and sealing may also be placed within the modules 10*a*-10*c* of the frame 14 for use with the conveyor 120.

The cup may be made of, for example, a thermoplastic such as polypropylene or polyethylene. Alternately, the cup material can be coated or uncoated paper, and the cup may be compostable. In some constructions, the cup is partially or entirely constructed from recycled materials. The cup may be filled with a comestible. The comestible can be in liquid or semi-liquid form. For example, the comestible may be orange juice, tomato juice, milk, ice cream, soft drinks, gelatin type desserts, salads, and other types of food. The cups are provided with tapered (e.g., truncated cone) walls having an enlarged upper open end having a thickened or rolled lip. The cup may be shaped in many ways. Common shapes for cups include square or rectangular cups with single or multiple cavities. The cups may be round cups that vary in diameter, height, and taper. Oval cups and cups that are joined to form multiple individual containers separated by the end user for single use are also conceived. In some instances, and especially when the cups are asymmetric, there may be a need for consistent orientation of the cup during processing in the cup filling and sealing apparatus 10. A cover (sometimes referred to as a "seal") that closes the open end of the cup may be applied to the lip. As such, the cup is closed and sealed by the cover to prevent spilling and contamination of the comestibles or other contents within the cup. The cover can be made from, for example, foil, plastic, or an organic film, and/or a coated paper or plastic.

As previously mentioned, process units 24 may be mounted to the rails 18 for operation in each module 10*a*-10*c* of the apparatus 10. Each process unit 24 may be mounted within any of the modules 10*a*-10*c* so long as the axial length of the module 10*a*-10*c* is appropriate for the process unit 24. For example, a single process unit 24 can be mounted on the rails 18 of the module 10*a*, removed from the module 10*a*, and replaced into engagement with the rails 18 of the second module 10*b*. As previously mentioned, multiple process units 24 may be positioned within a single module 10*a*-10*c*. In the illustrated embodiment, each rail 18 has a common cross-section to permit usage of the rail 18 within any of the modules 10*a*-10*c* and permit interchangeable attachment of the process unit 24 onto the rails 18 within any of the modules 10*a*-10*c*. For example, the illustrated rails 18 all have a circular cross-section taken perpendicular to the longitudinal axis 20. It is also noted that the rails 18 may be of solid material (e.g., metal) cross-section with the exception of the ends 18*a*, 18*b*.

Each process unit 24 functions in conjunction with the conveyor 120 to complete a task associated with cup filling and sealing on the cup. For example, the process unit 24 within the module 10*a* receives the cup from the conveyor 120, and completes a first task on the cup. Then, the process unit 24 returns the cup to the conveyor 120. The cup is passed to the next module 10*b* by the conveyor 120 for completing the successive task, and so on. As such, each process unit 24 accomplishes at least one task of a series of tasks of the cup filling and sealing apparatus 10.

Figure 9:
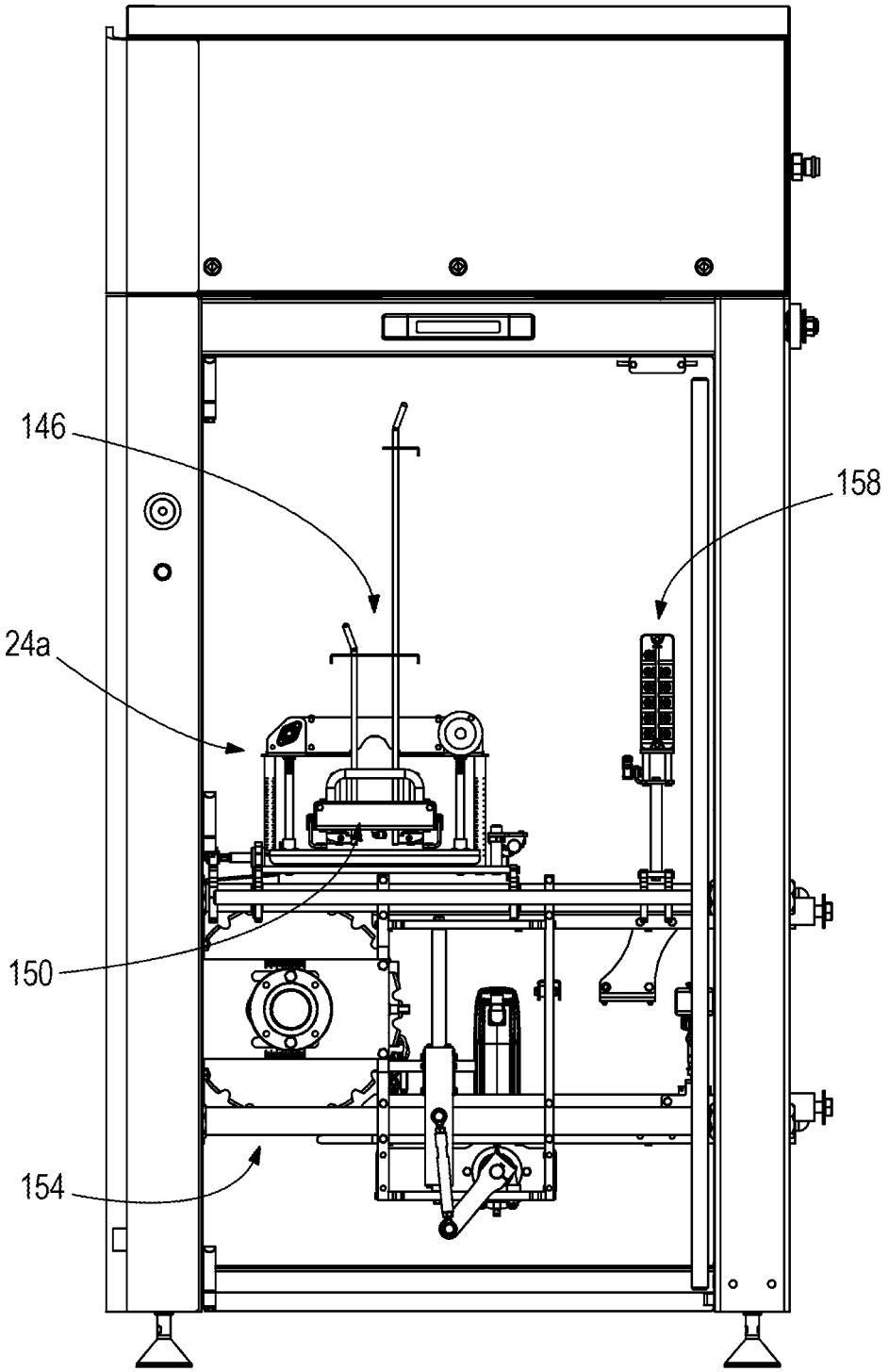
FIG. 9 is a side view of an infeed subassembly mounted within a module of the modular machine system of FIG. 1.

FIG. 9 illustrates an infeed process unit 24*a*. The infeed process unit 24*a* functions as a point of access on the apparatus 10 where cups are loaded into a magazine 146, and individually dispensed into a carrier plate 150 (i.e., a cup holder). A vacuum pull down station 154 may be used to assist in placing the cups into the carrier plate 150 so that it the cups are properly aligned within the carrier plate 150. As the conveyor indexes the carrier plates 150 (i.e., translates the carrier plates 150 along the longitudinal axis 20), a series of sensors 158 are used to check if there are multiple cups in a single carrier plate 150 pocket, or if a cup is missing entirely.

Figure 10:
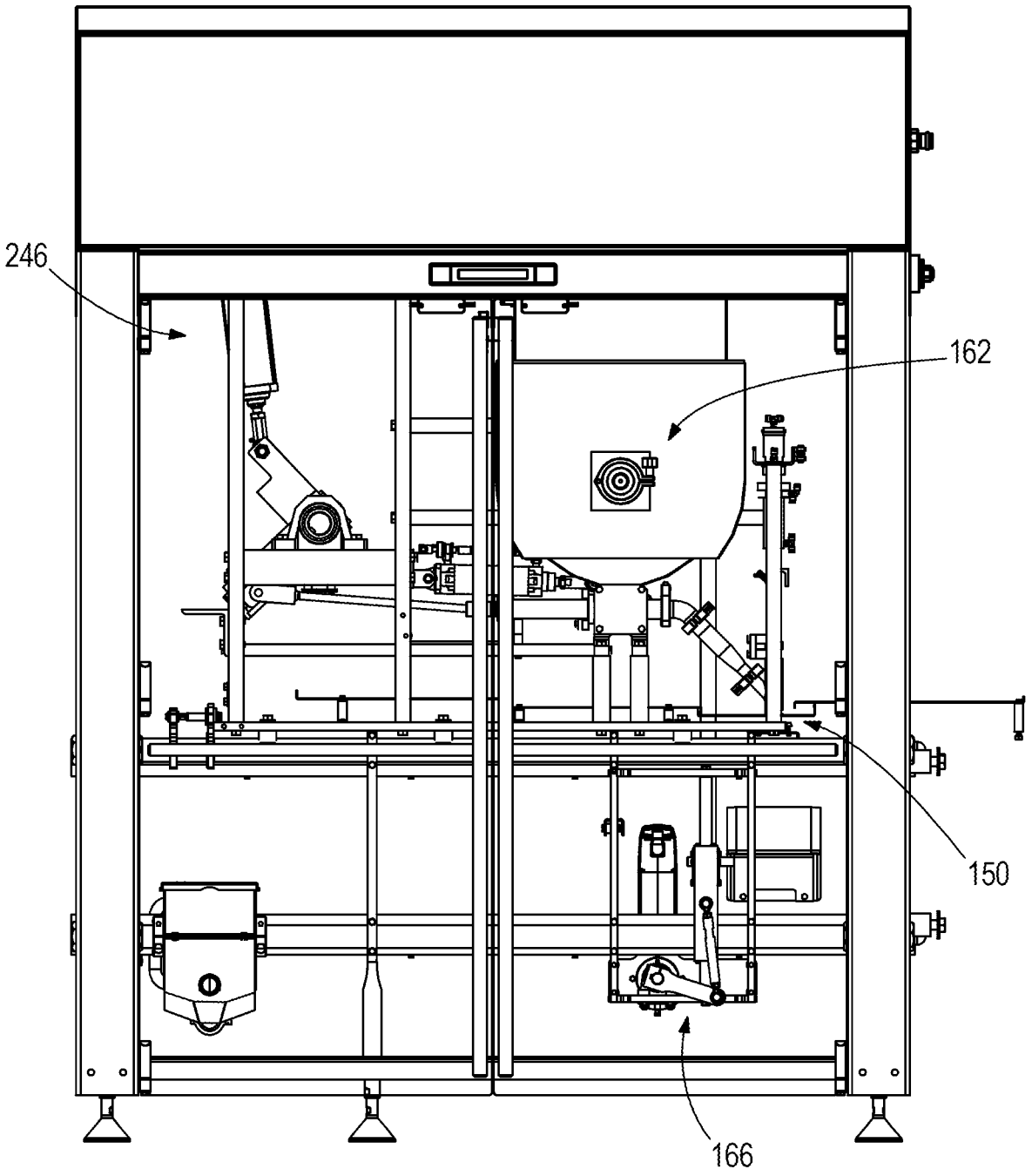
FIG. 10 is a side view of a dosing subassembly mounted within a module of the modular machine system of FIG. 1.

FIG. 10 illustrates a dosing process unit 24*b*. The dosing process unit 24*b* contains a pump apparatus 162 that doses a particular product (e.g., yogurt, cream cheese, sour cream, etc.) into the cup. A fill lift mechanism 166 may be employed within this module to assist in lifting the cups partially out of the carrier plate 150 to prevent product splashing out of the cups.

Figure 11:
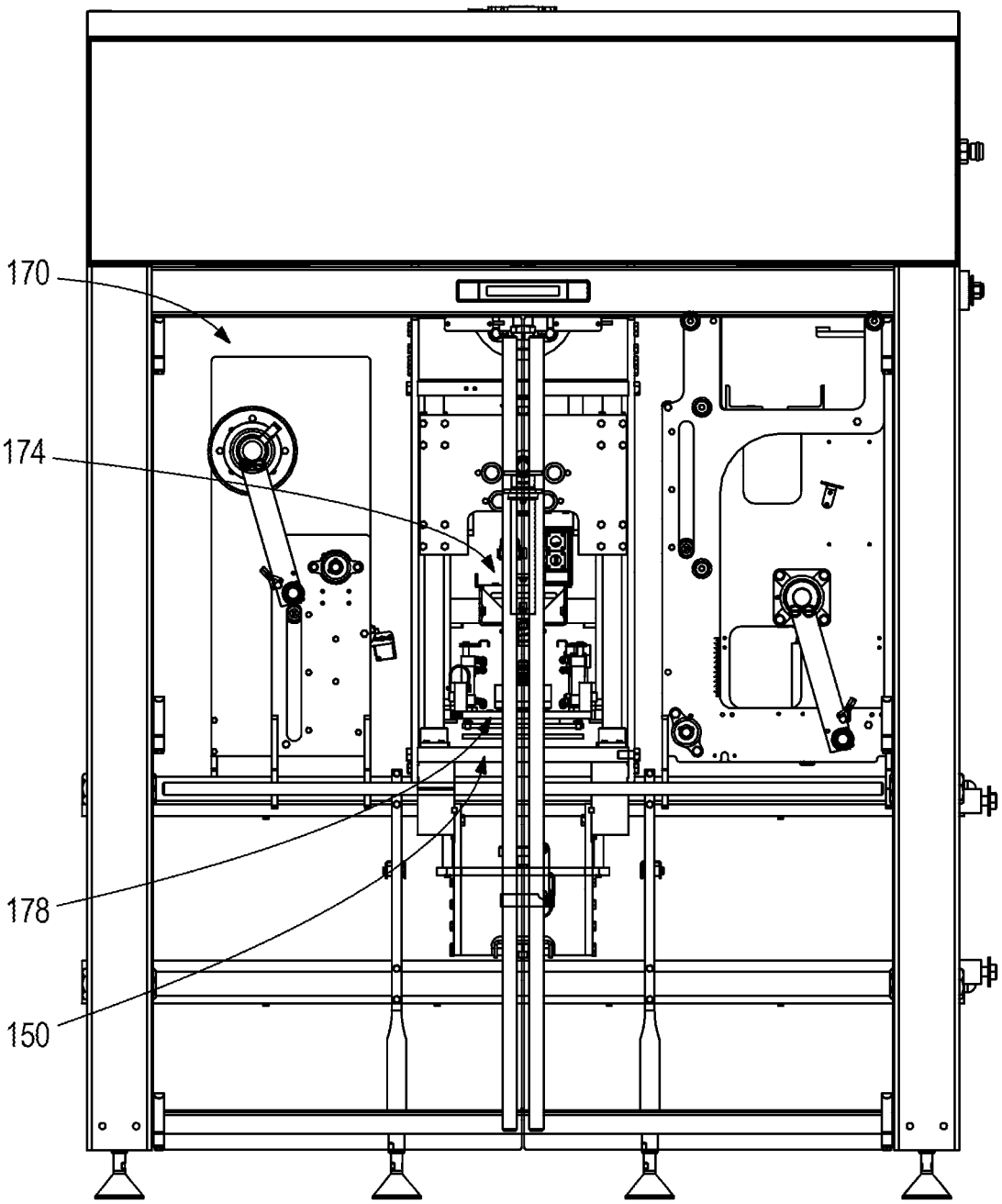
FIG. 11 is a side view of a sealing subassembly mounted within a module of the modular machine system of FIG. 1.

FIG. 11 illustrates a sealing process unit 24*c*. The sealing process unit 24*c* contains a cup sealing apparatus 170 configured to apply a sealing material (as described above), which may be metallic foil lids or a roll stock film, to the top of the cup. The cup sealing apparatus 170 is operable to positively seal the cup through a combination of heat and pressure, provided by a drive mechanism 174 and heater heads 178. In one embodiment of the sealing process unit 24*c*, the heater heads 178 are configured to float to align with a cup that is misaligned relative to the carrier plate 150.

Figure 12:
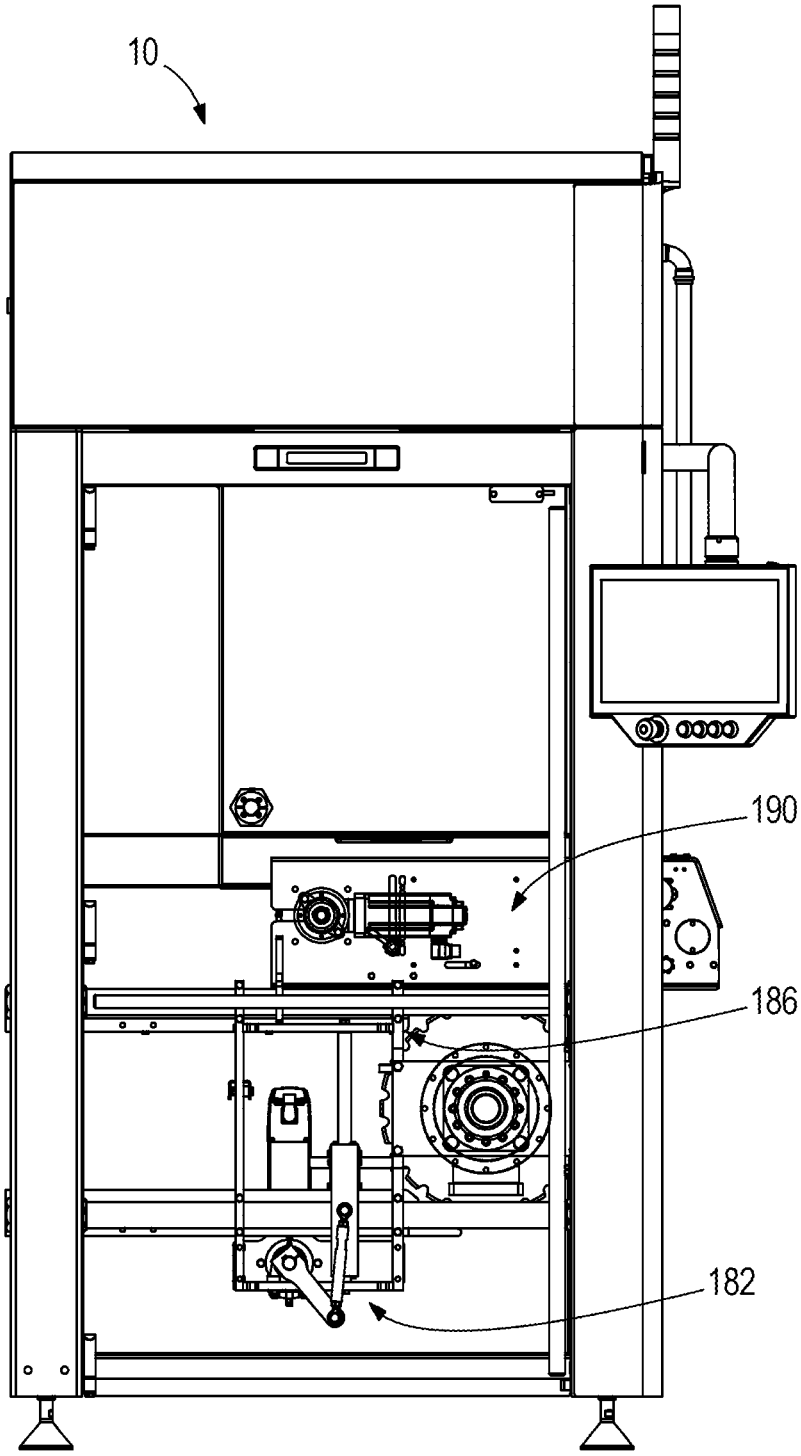
FIG. 12 is a side view of a discharge subassembly mounted within a module of the modular machine system of FIG. 1.

FIG. 12 illustrates a discharge process unit 24*d*. The discharge process unit 24*d* provides for the sealed cups to be discharged from the apparatus 10 and onto other equipment, such as a stand-alone belted conveyor (not shown). A lift out station 182 is typically used to fully lift the cups out of the carrier plates 150 into a position for which the cups are able to be swept off of the lift out station 182, out of pedestals 186, and through a discharge sweep station 190 to be exited from the apparatus 10.

Figure 4:
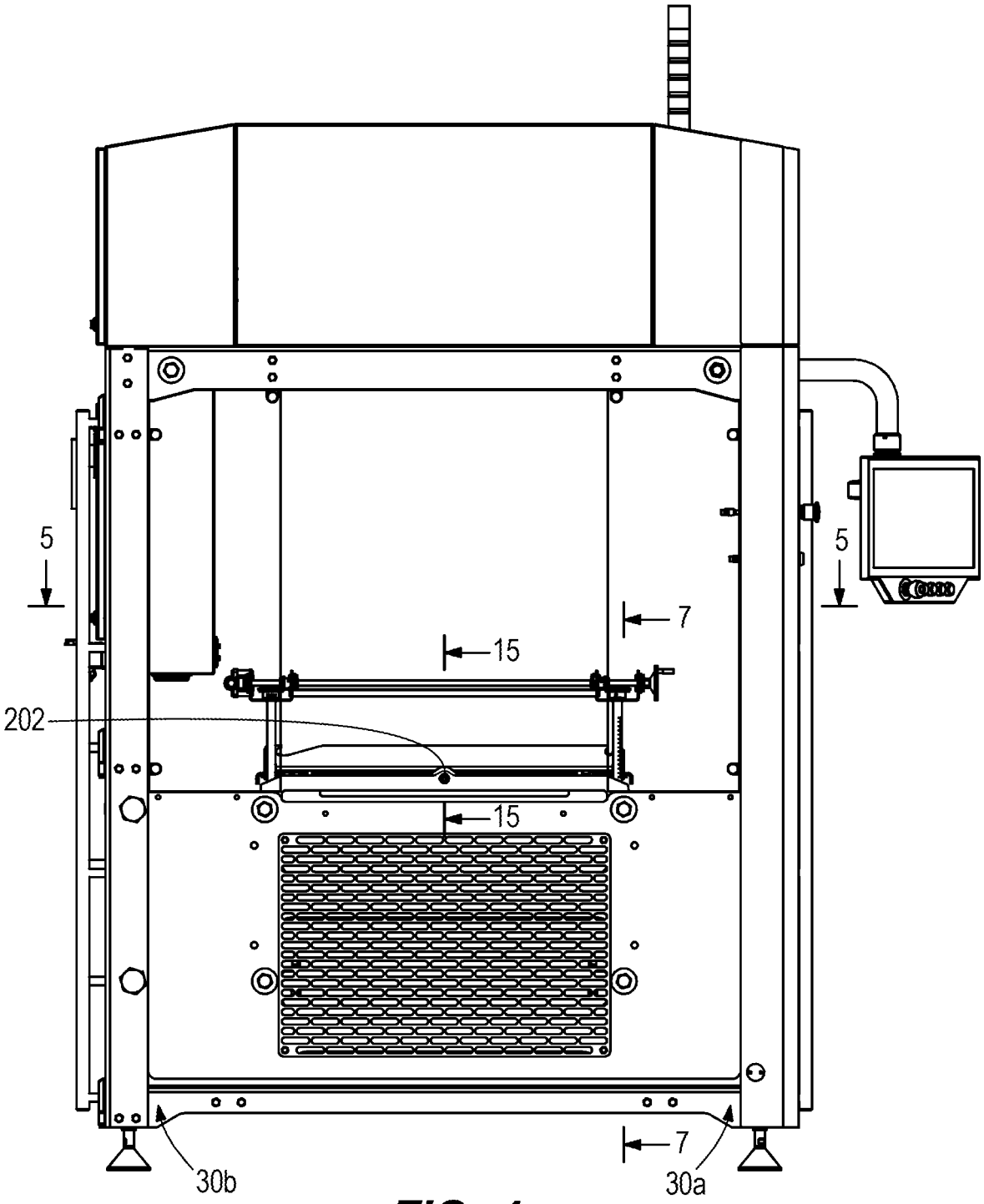
FIG. 4 is a side view of the modular machine system of FIG. 1.
Figure 8:
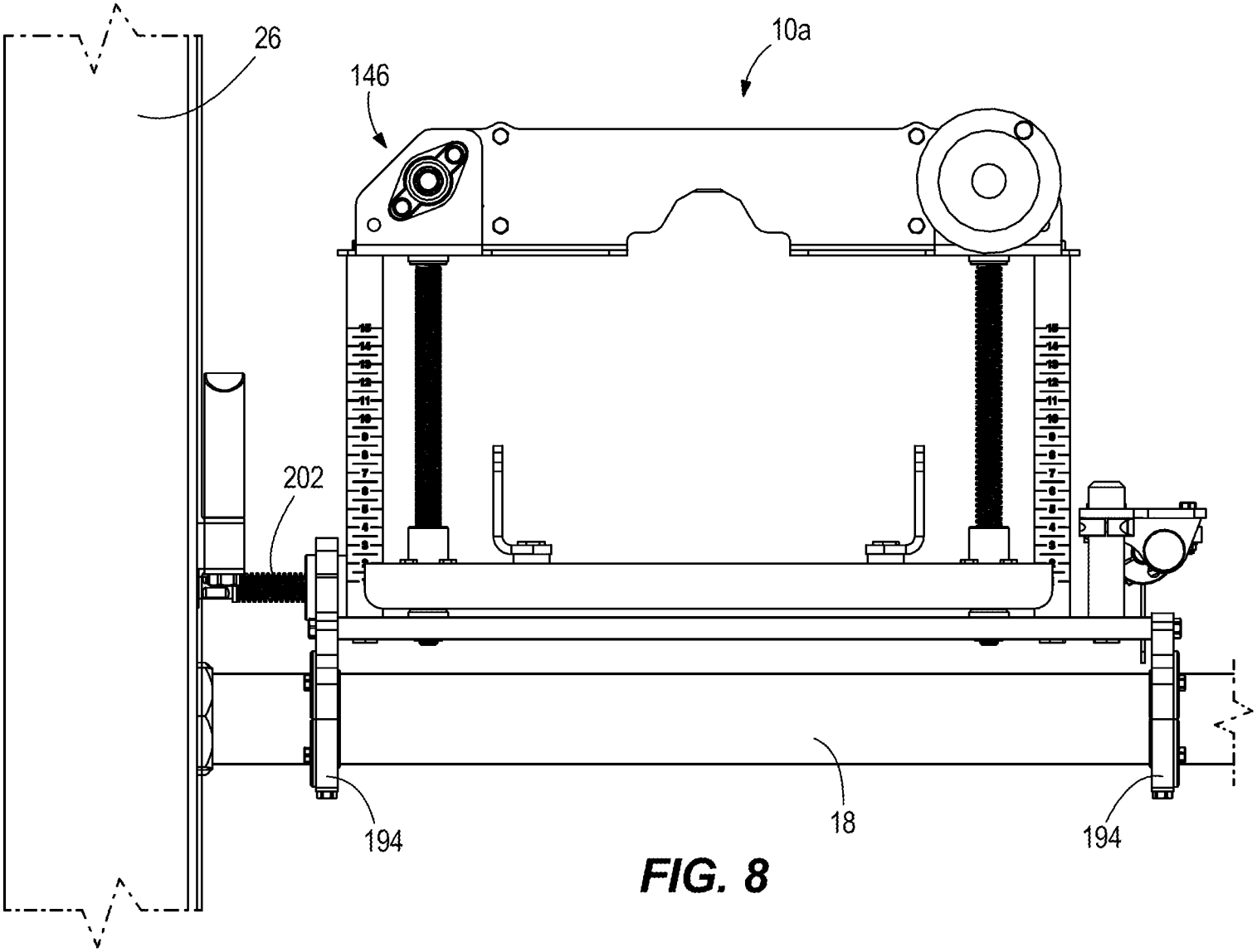
FIG. 8 is an enlarged side view of the modular machine system of FIG. 1 taken along section line 8-8 in FIG. 2.

Returning to FIGS. 7 and 8, a portion of the magazine 146 is illustrated. The magazine 146 is supported on the rails 18 by a longitudinal alignment plate 194. In the illustrated embodiment, there are two longitudinal alignment plates 194 connecting the magazine 146 to two upper rails 18 of the first module 10*a*. The alignment plates 194 are loosely fitted around the rails 18 to permit longitudinal translation of the magazine 146 along the longitudinal axis 20 upon receiving a threshold force along the longitudinal axis 20, but to inhibit motion of the magazine 146 along the longitudinal axis 20 upon receiving a force lower than the threshold force along the longitudinal axis 20 (e.g., during operation of the magazine 146). Another alignment plate 198 is fastened to the upper rails 18 at a fixed position along the longitudinal axis 20. A jack screw 202 connects the alignment plate 194 to the alignment plate 198, and the jack screw 202 is operable to apply the threshold force to move the alignment plate 194 relative to the alignment plate 198. As such, the magazine 146 is movable along the rails 18 by operation of the jack screw 202. The magazine 146 may have additional adjustable features to locate the magazine 146 in an operable position aligned with the vacuum pull down station 154. As illustrated in FIG. 4, the jack screw 202 is located between the first and second lateral ends 34*a*, 34*b* of the module 10*a*, for example in a laterally central region or lateral center position. As such, the alignment process using the jack screw 202 can be carried out by a technician from either lateral side of the apparatus 10, not only from a single designated service side of the apparatus 10. Moreover, the alignment plates 194, 198 and the jack screw 202 may dispense with any individual alignment mechanisms that align portions separately, ensuring that the magazine 146 maintains a consistent orientation on the rails 18 during longitudinal alignment. The magazine 146 may be replaced with a component of or an entirely different functional process unit 24 such that the different functional process unit 24 is movable along the longitudinal axis 20 as described above with respect to the magazine 146.

Figure 13:
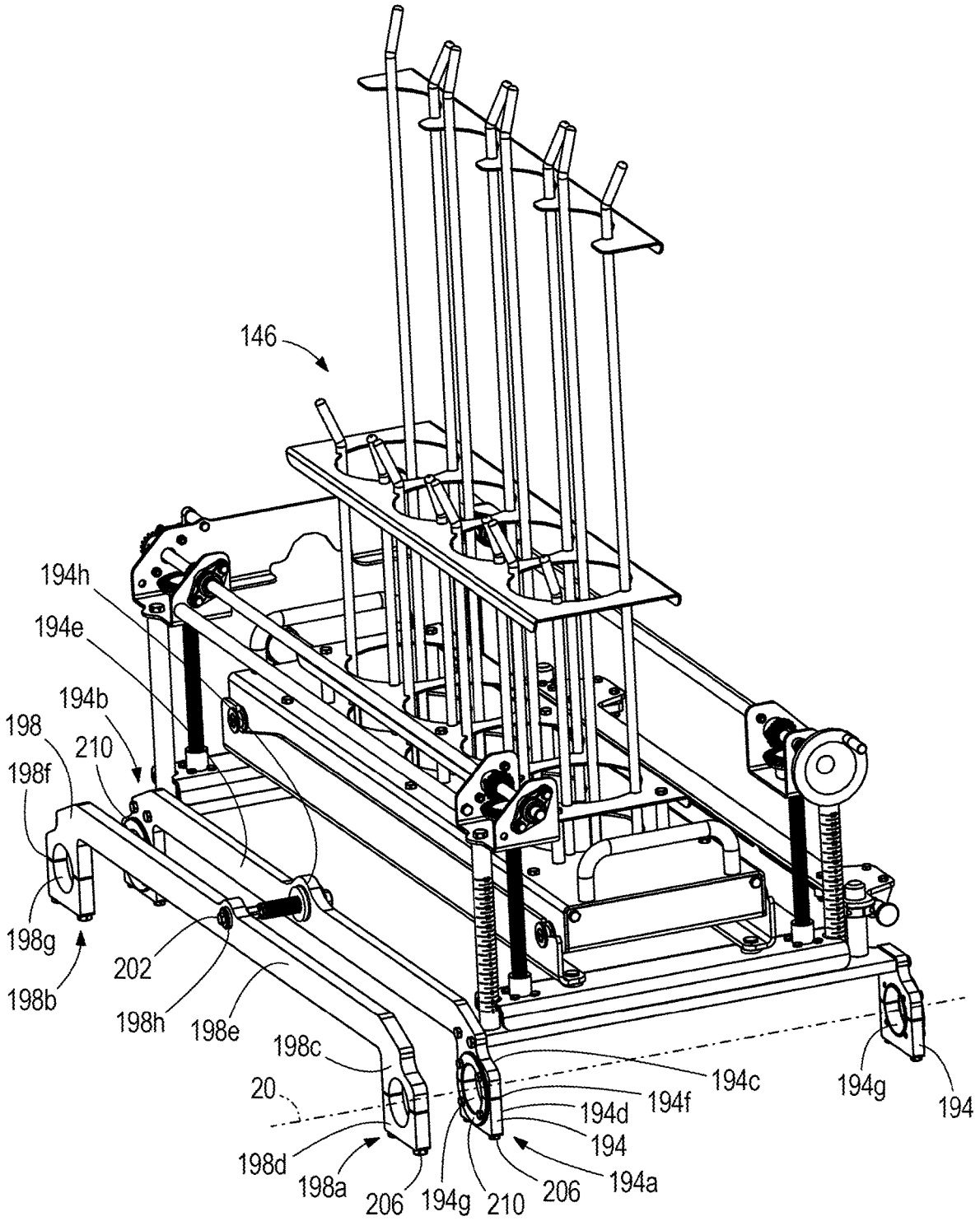
FIG. 13 is a perspective view of a vacuum pull down station of the infeed subassembly of FIG. 9.
Figure 14:
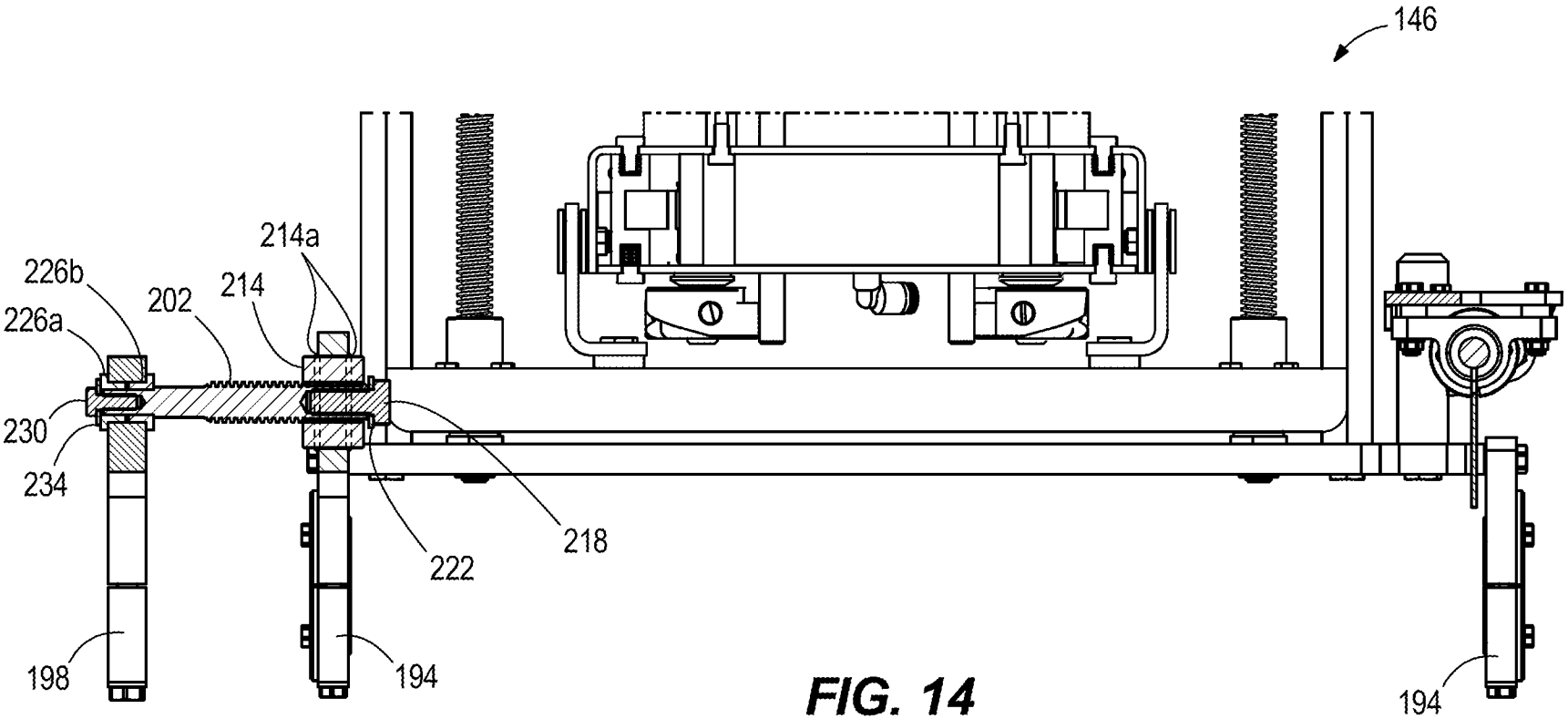
FIG. 14 is a side view of the vacuum pull down station of FIG. 13.
Figure 15:
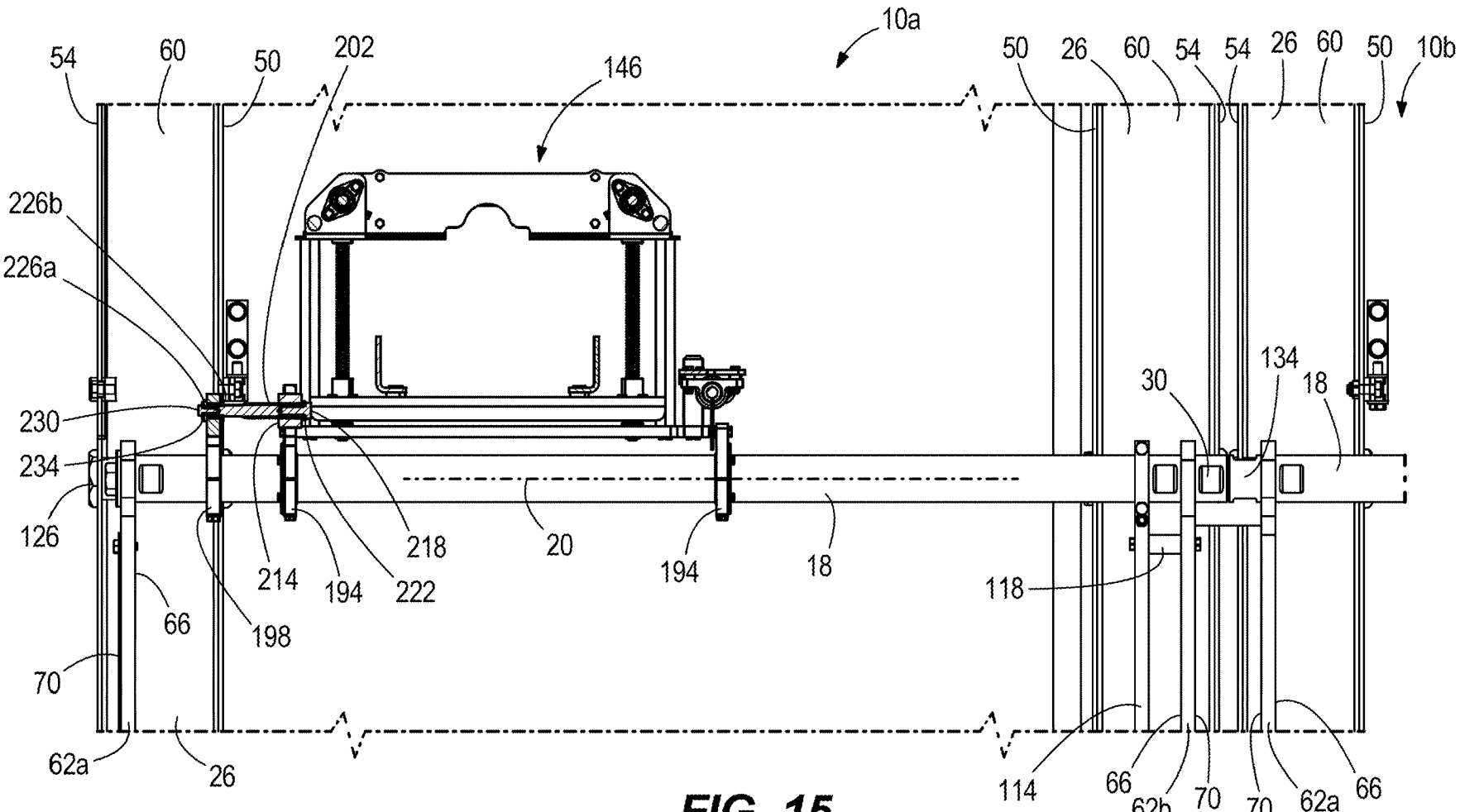
FIG. 15 is a cross-sectional view of the modular machine system taken along section line 15-15 in FIG. 4.
Figure 16:
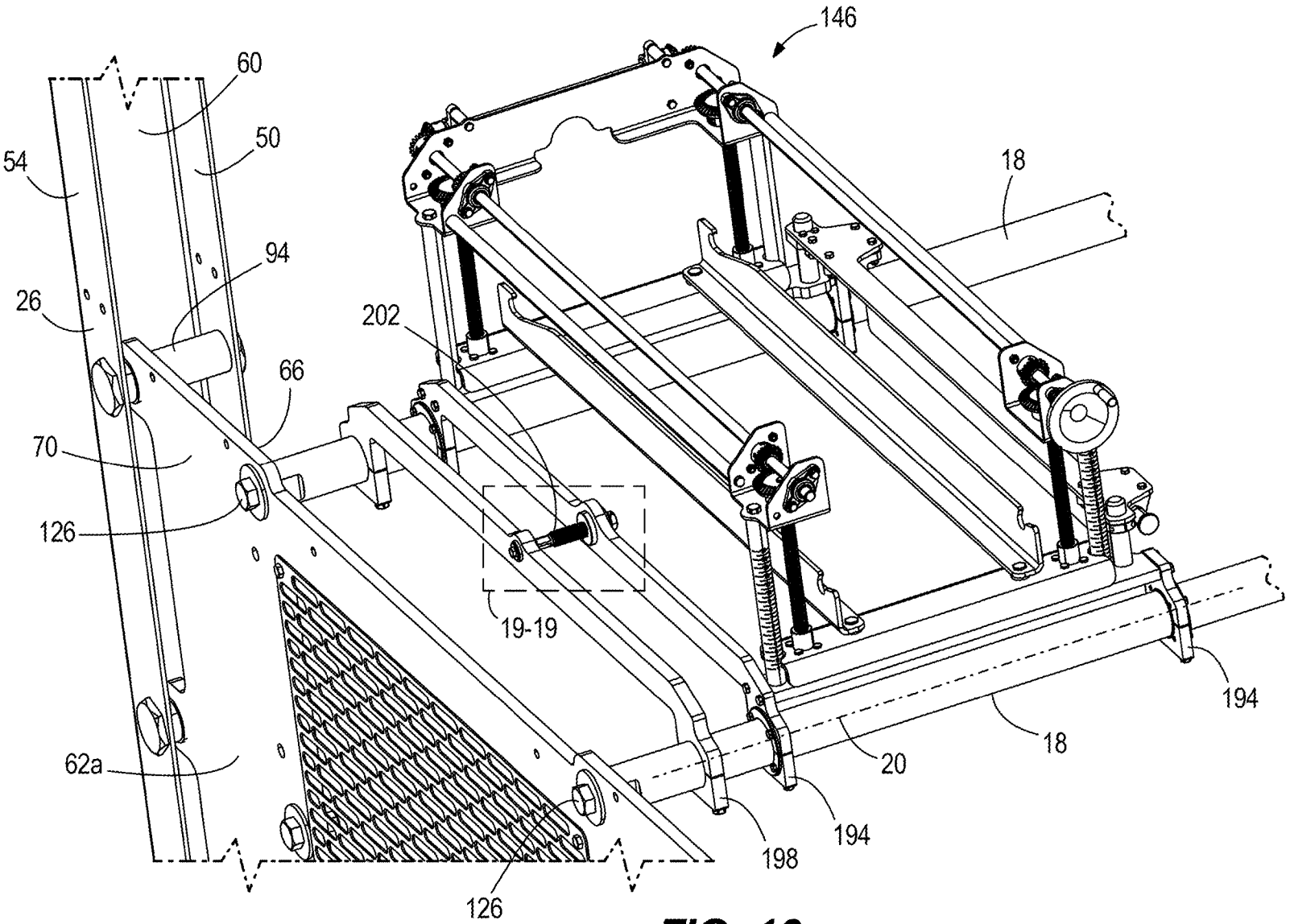
FIG. 16 is another top perspective view of the modular machine system of FIG. 1.
Figure 17:
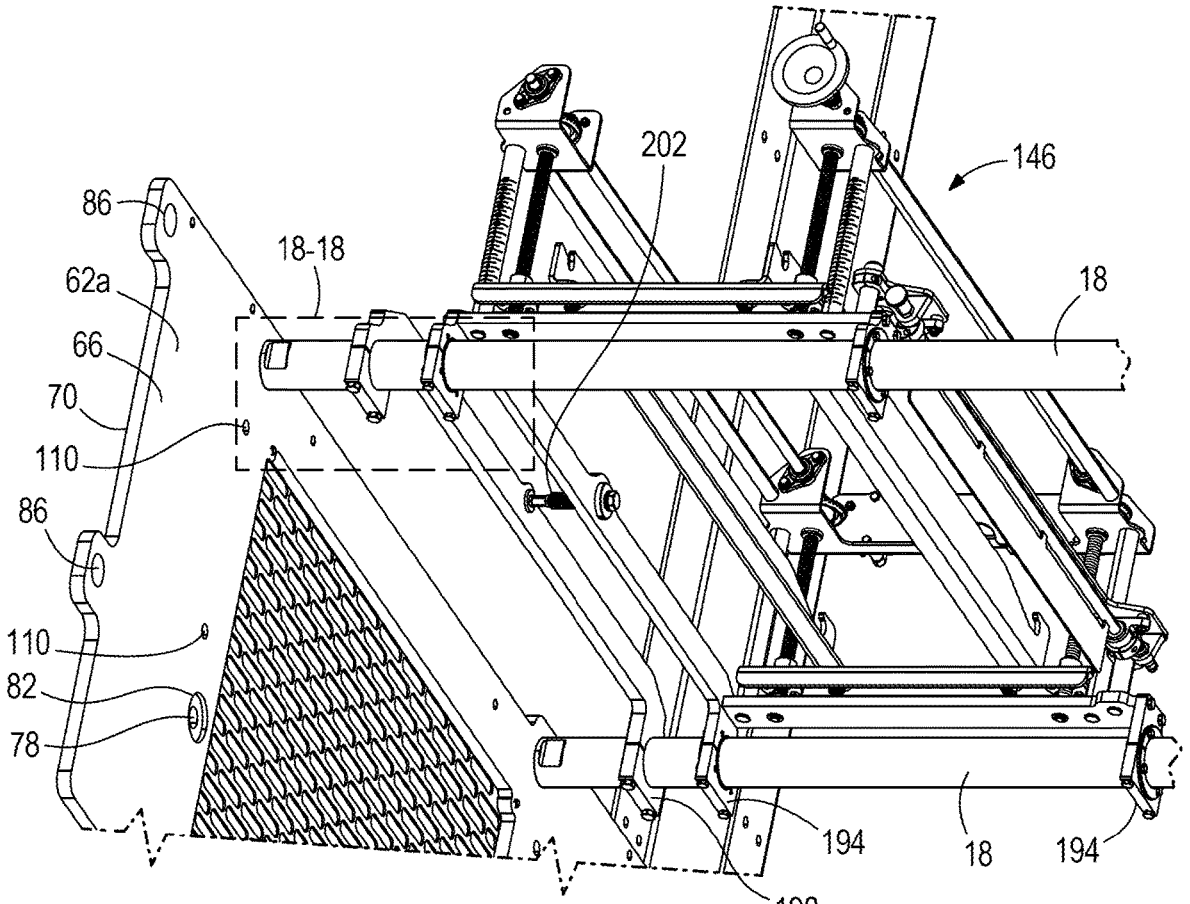
FIG. 17 is a bottom perspective view of the modular machine system of FIG. 1.

In the illustrated embodiment of FIG. 13, the jack screw 202 is located at a lateral position between each of the rails 18 which the alignment plates 194, 198 are supported. In the illustrated embodiment, the jack screw 202 is located at a lateral position equally spaced from each of the rails 18 (i.e., a lateral midpoint of the alignment plates 194, 198). As illustrated in FIG. 4, the jack screw 202 is located equidistant from the first and second lateral ends 34*a*, 34*b* of the module 10*a*. This allows a user to operate the jack screw 202 at either lateral side of the apparatus 10. The jack screw 202 is aligned parallel with the longitudinal axis 20 such that operation of the jack screw 202 above the threshold force translates the magazine 146 along the longitudinal axis 20. In the illustrated embodiment, the magazine 146 may has additional adjustable features to locate the magazine 146 in an operable position (e.g., along the lateral axis 21 or the vertical axis 22) for use with the vacuum pull down station 154.

With continued reference to FIG. 13, each alignment plate 194, 198 includes a first lateral end 194*a*, 198*a*, and a second lateral end 194*b*, 198*b*. Each lateral end 194*a*, 198*a*, 194*b*, 198*b* includes a top portion 194*c*, 198*c*, and a bottom portion 194*d*, 198*d*. In the illustrated embodiment, each top portion 194*c*, 198*c* and bottom portion 194*d*, 198*d* are connected by a central portion 194*e*, 198*e*, which spans between the first lateral end 194*a*, 198*a* and the second lateral end 194*b*, 198*b*. The central portions 194*e*, 198*e* each include a jack screw hole 194*h*, 198*h* operable to receive the jack screw 202.

Figure 18:
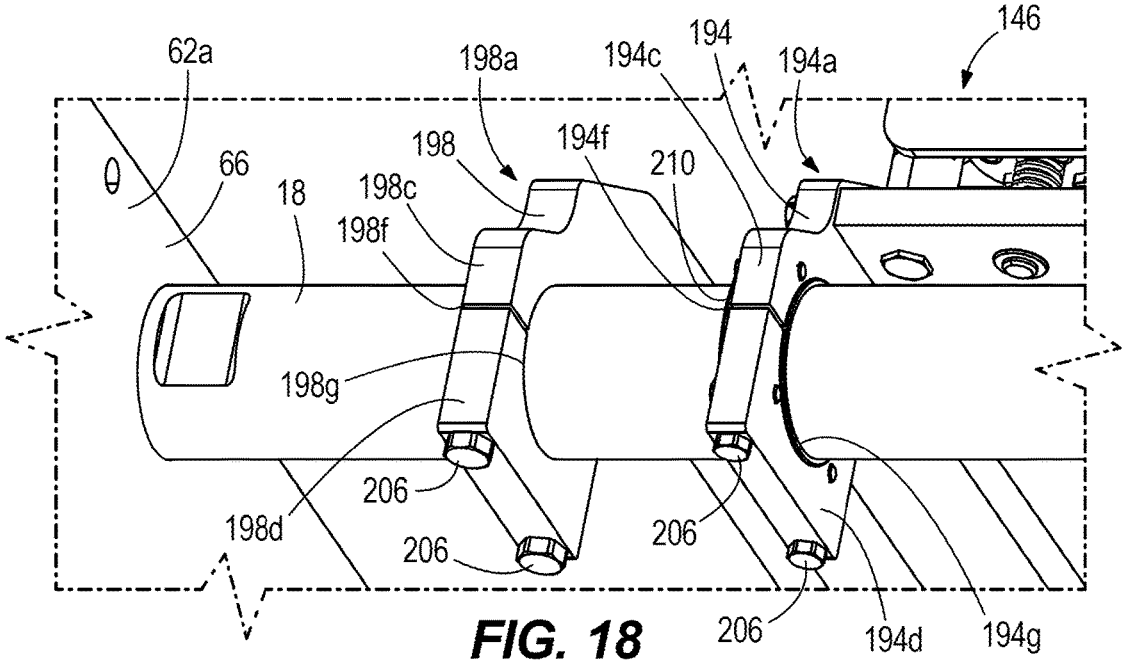
FIG. 18 is an enlarged bottom perspective view of the modular machine system of FIG. 17 taken along section line 18-18 in FIG. 17.

Further, as best shown in FIG. 18, each top portion 194*c*, 198*c* and bottom portion 194*d*, 198*d* are separable from each other at a parting line 194*f*, 198*f* defining a rail hole 194*g*, 198*g* with the top portion 194*c*, 198*c* and the bottom portion 194*d*, 198*d*. The top portions 194*c*, 198*c* and bottom portions 194*d*, 198*d* are connected to each other by fasteners 206. The fasteners 206 extend through the first and second lateral ends 194*a*, 198*a*, 194*b*, 198*b* such that each alignment plate 194, 198 surrounds the rail 18. In the illustrated embodiment, the fasteners 206 extend parallel to the vertical axis 22. As such, when the fasteners 206 connect the top portions 194*c*, 198*c*, to the bottom portions 194*d*, 198*d* while surrounding the rails 18, each alignment plate 194, 198 and thus the magazine 146 is supported on the rails 18.

With continued reference to FIG. 13, a bushing 210 is located between each alignment plate 194 and the rail 18. More specifically, each alignment plate 194 has a bushing 210 located at each lateral end 194*a*, 194*b* between the top portion 194*c* and the bottom portion 194*d* and the rail 18. The bushing 210 inhibits motion of the magazine 146 along the longitudinal axis 20 upon receiving a force lower than the threshold force along the longitudinal axis 20 (e.g., during operation of the magazine 146). As such, the alignment plate 194 loosely supports the magazine 146 upon the rails 18. The bushing 210 is sized to engage the rail holes 194*g* of the alignment plate 194. The rail hole 198*g* of the alignment plate 198 may be sized to contact the rail 18 directly such that the alignment plate 198 is fixed to the rail 18 in a direction parallel to the longitudinal axis 20.

Figure 19:
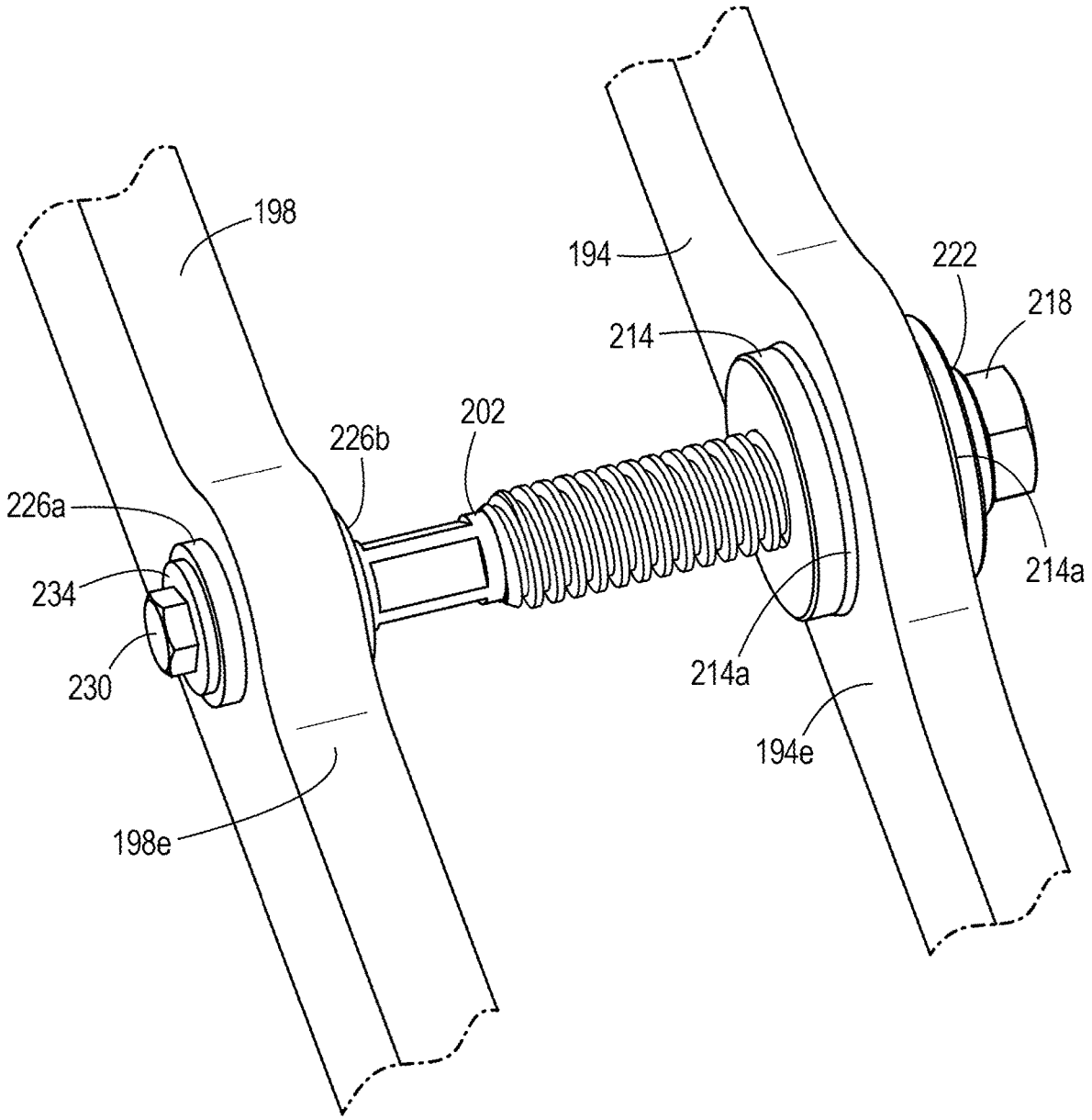
FIG. 19 is an enlarged top perspective view of a jack screw of the modular machine system taken along section line 19-19 in FIG. 16.
Figure 20:
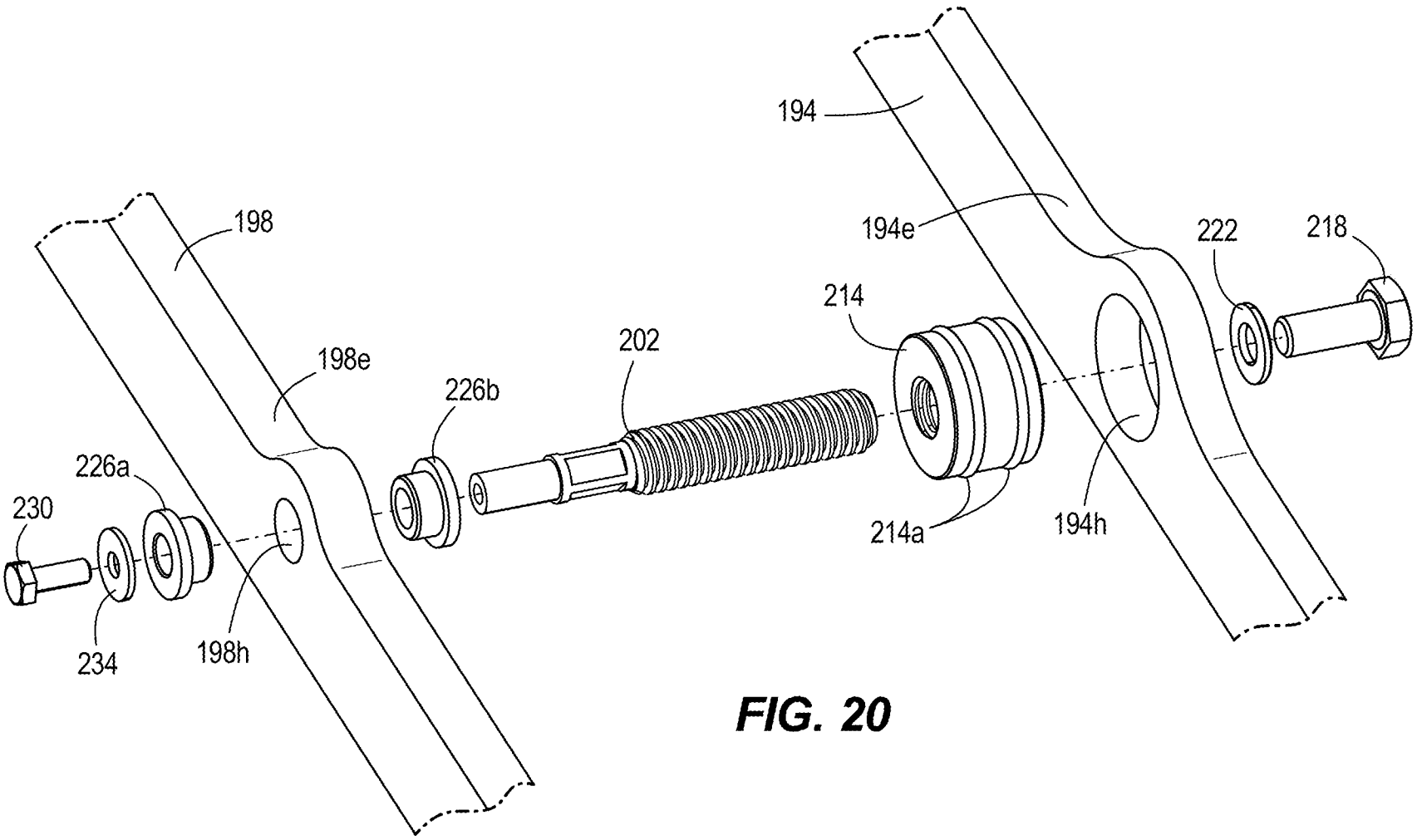
FIG. 20 is an exploded view of the jack screw of the modular machine system of FIG. 19.

FIGS. 19 and 20 illustrate the connection between the alignment plates 194, 198 with the jack screw 202 in detail. A sleeve nut 214 is provided between the jack screw 202 and the alignment plate 194, the sleeve nut 214 engaging the jack screw 202. In the illustrated embodiment, the sleeve nut 214 and the jack screw 202 are threaded, with the threads of the sleeve nut 214 engaging threads of the jack screw 202. The sleeve nut 214 is positioned radially outwardly of the jack screw 202 to engage the jack screw hole 194*h* of the alignment plate 194. In the illustrated embodiment, the sleeve nut 214 includes sleeve nut retainers 214*a* positioned on either longitudinal side (i.e., along the longitudinal axis 20) of the alignment plate 194 configured to optionally seal the sleeve nut 214 at the same longitudinal position relative to the alignment plate 198 (i.e., along the longitudinal axis 20) as the alignment plate 194. Further, the sleeve nut retainers 214*a* are responsible for preventing the sleeve nut 214 from spinning inside the alignment plate 194. The sleeve nut retainers 214*a* project radially outwardly from the sleeve nut 214 such that the sleeve nut retainers 214*a* longitudinally abut either side of the alignment plate 194.

When the jack screw 202 is rotated to apply at least a threshold force (i.e., static friction between the bushing 210 and the rail 18), the jack screw 202 applies a torque to the sleeve nut 214. The torque applied from the jack screw 202 to the sleeve nut 214 results in a longitudinal force along the longitudinal axis 20 applied to the sleeve nut 214. As a result of the longitudinal force, the sleeve nut 214 is translated along the longitudinal axis 20, causing translational motion of the alignment plate 194 and thus the magazine 146 along the longitudinal axis 20 relative to the alignment plate 198. A bolt 218 engages the jack screw 202 adjacent the sleeve nut 214. The bolt 218 prevents the jack screw 202 from being disengaged (i.e., having the threads of the jack screw 202 be removed) from the sleeve nut 214. A washer 222 is positioned longitudinally between the head of the bolt 218 and the jack screw 202.

At the opposite end of the jack screw 202, flanged guide bushings 226*a*, 226*b* are located within and locate the jack screw 202 within the jack screw hole 198*h* of the alignment plate 198. The flanged guide bushiness 226*a*, 226*b* align the jack screw 202 parallel with the longitudinal axis 20. The flanged guide bushings 226*a*, 226*b* include heads which protrude radially outwardly from jack screw hole 198*h* on either longitudinal side of the alignment plate 198. A bolt 230 engages the jack screw 202 adjacent the flanged guide bushings 226*a*, 226*b*. A washer 234 is positioned longitudinally between the head of the bolt 230 and the jack screw 202.

In the cup filling and sealing apparatus 10, the jack screw 202 is used to translate the magazine 146 between a first desired longitudinal position relative to the alignment plate 198 and a second desired longitudinal position displaced from the first desired longitudinal position. As such, the magazine 146 is movable along the rails 18 without disassembling the cup filling and sealing apparatus 10 and reassembling the magazine 146 onto the rails 18. As the magazine 146 is shifted along the rails 18 with the jack screw 202, a distance between the magazine 146 (or another process unit 24) and the other process units 24 of the cup filling and sealing apparatus 10 is adjusted. The conveyor can then be operated such that successive process units 24 can perform a function (e.g., infeed, dosing, sealing, discharge, etc.) to the cup without the respective process unit 24 being longitudinally (e.g., along the longitudinal axis 20) misaligned from a desired position along the cup filling and sealing apparatus 10 corresponding with the index length of the conveyor.

Optionally, the conveyor may include an end (not shown) which is connected to the alignment plate 194. As such, upon rotation of the jack screw 202, the tension of a belt (not shown) of the conveyor which passes between ends of the conveyor is adjusted. Alternatively, the alignment plate 194 may be separate from the magazine 146 so to adjust the tension in the belt of the conveyor independent of the magazine 146. The jack screw 202 may engage another component of any of the process units 24 other than the magazine 146.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

Various features of the invention are set forth in the following claims.

What is claimed is:

1. A modular processing machine including a plurality of process units for completing a series of sequential tasks on a work piece conveyed through the modular processing machine, the modular processing machine comprising:

a module including, a mounting plate, a rail extending along a longitudinal axis, the rail being connected to the mounting plate, a first longitudinal alignment plate fastened to the rail at a predetermined longitudinal distance from the mounting plate, a jack screw connected to the first longitudinal alignment plate, and a process unit including a second longitudinal alignment plate connected to the jack screw and supported by the rail, the process unit being mounted to the second longitudinal alignment plate and being operable to perform a task associated with the module, wherein the jack screw is operable to translate the process unit along the rail between a first desired longitudinal position relative to the first longitudinal alignment plate and a second desired longitudinal position displaced from the first desired longitudinal position.

2. The modular processing machine of claim 1, wherein the jack screw is located at a lateral midpoint between lateral ends of the first longitudinal alignment plate such that the jack screw is operable by an operator from either lateral side of the modular processing unit.

3. The modular processing machine of claim 1, wherein the module includes a second rail extending parallel to the longitudinal axis, the second rail being connected to the mounting plate, the first longitudinal alignment plate being fastened to both the rail and the second rail at the predetermined longitudinal distance.

4. The modular processing machine of claim 3, wherein the second longitudinal alignment plate is supported by both the rail and the second rail.

5. The modular processing machine of claim 1, wherein both the first longitudinal alignment plate and the second longitudinal alignment plate are generally planar and extend perpendicular to the longitudinal axis, the first longitudinal alignment plate and the second longitudinal alignment plate each having a rail hole extending parallel to the longitudinal axis, the rail hole operable to surround the rail and support the first longitudinal alignment plate and the second longitudinal alignment plate on the rail.

6. The modular processing machine of claim 1, wherein at least one of the first longitudinal alignment plate and the second longitudinal alignment plate include a top portion and a bottom portion which are attached together by a fastener such that the top portion and the bottom portion cooperate to surround the rail.

7. The modular processing machine of claim 1, wherein the process unit further comprises a bushing radially between the second longitudinal alignment plate and the rail, the bushing inhibiting translational movement of the second longitudinal alignment plate along the longitudinal axis upon operation of the of the process unit, and the bushing permitting translational movement of the second longitudinal alignment plate along the longitudinal axis when the jack screw applies at least a threshold force to the second longitudinal alignment plate.

8. The modular processing machine of claim 1, further comprising a second module including a second mounting plate, and a second rail coaxial with the longitudinal axis, the second rail being connected to the second mounting plate, and further comprising a second process unit mounted to the second rail, wherein the jack screw is operable to translate the process unit along the rail such that a distance between the process unit and the second process unit is adjusted.

9. The modular processing machine of claim 1, wherein both the first longitudinal alignment plate and the second longitudinal alignment plate include a rail hole configured to surround the rail and a jack screw hole configured to receive the jack screw.

10. The modular processing machine of claim 9, wherein the process unit further comprises a third longitudinal alignment plate connected to the second longitudinal alignment plate, the third longitudinal alignment plate having a rail hole.

11. The modular processing machine of claim 1, further comprising a sleeve nut configured to secure the jack screw to the first longitudinal alignment plate and a bushing configured to secure the jack screw to the second longitudinal alignment plate.

12. The modular processing machine of claim 11, wherein the sleeve nut further comprises a sleeve nut retainer on either longitudinal side of the second longitudinal alignment plate.

13. The modular processing machine of claim 11, wherein the jack screw further comprises a second bushing, and the bushing and the second bushing are flanged bushings having heads on either longitudinal side of the first longitudinal alignment plate.

14. The modular processing machine of claim 1, further comprising a conveyor, the conveyor having an end connected to the second longitudinal alignment plate to adjust tension of the conveyor.

15. A modular processing machine including a plurality of process units for completing a series of sequential tasks on a workpiece conveyed through the modular processing machine, the modular processing machine comprising:

a first module including, a first rail extending along a longitudinal axis, the first rail having a first axial end, and a first longitudinal alignment plate fastened to the first rail at a predetermined longitudinal distance from the first axial end, a jack screw connected to the first longitudinal alignment plate, a first process unit mounted within the first module on the first rail, the first process unit being operable to perform a first task associated with the first module, the first process unit including a second longitudinal alignment plate connected to the jack screw and supported by the first rail, and a second module including, a second rail extending coaxially with the longitudinal axis, the second rail having a second axial end connected to the first axial end, and a second process unit operable to perform a second task associated with the second module, the second process unit mounted within the second module on the second rail, wherein the jack screw is operable to shift the second longitudinal alignment plate relative to the first longitudinal alignment plate in a longitudinal direction between a first longitudinal position relative to the first axial end and a second longitudinal position displaced from the first longitudinal position.

16. The modular processing machine of claim 15, further comprising a third process unit within the first module, the third process unit being operable to perform a third task associated with the first module.

17. The modular processing machine of claim 16, wherein the jack screw is located at a lateral midpoint between lateral ends of the first longitudinal alignment plate such that the jack screw is operable by an operator from either lateral side of the modular processing machine.

18. The modular processing machine of claim 15, further comprising a mounting plate within the first module configured to support the first rail relative to the ground.

19. The modular processing machine of claim 18, further comprising a column within the first module fastened to the mounting plate to support the first rail relative to the ground.

20. The modular processing machine of claim 15, wherein the first axial end of the first rail includes a first alignment feature and the second axial end of the second rail includes a second alignment feature, and the first and second alignment features form a male-female interface between the first module and the second module, the male-female interface aligned with the longitudinal axis.

* * * * *